US012102179B2

(12) United States Patent
Lai et al.

(10) Patent No.: US 12,102,179 B2
(45) **Date of Patent: *Oct. 1, 2024**

(54) SEPARABLE AND REGENERATIVE FOOTWEAR

(71) Applicant: TBL Licensing LLC, Stratham, NH (US)

(72) Inventors: Chao Yun Lai, Taichung (TW); Alexander Dardinski, Newburyport, MA (US); Tadd Nicholas Smith, Rye, NH (US); David Hass, Dover, NH (US)

(73) Assignee: TBL LICENSING LLC, Stratham, NH (US)

( * ) Notice: Subject to any disclaimer, the term of this patent is extended or adjusted under 35 U.S.C. 154(b) by 24 days.

This patent is subject to a terminal disclaimer.

(21) Appl. No.: 17/983,029

(22) Filed: Nov. 8, 2022

(65) Prior Publication Data

US 2023/0064528 A1 Mar. 2, 2023

Related U.S. Application Data

(63) Continuation-in-part of application No. 17/862,115, filed on Jul. 11, 2022, now abandoned, which is a (Continued)

(51) Int. Cl.

| | |
|---|---|
| ***A43B 3/24*** | (2006.01) |
| ***A43B 1/00*** | (2006.01) |
| ***A43B 1/10*** | (2006.01) |

(52) U.S. Cl.

CPC ..... *A43B 3/248* (2013.01); *A43B 1/0063* (2013.01); *A43B 1/10* (2013.01); *A43B 3/244* (2013.01)

(58) Field of Classification Search

CPC ..... A43B 3/24; A43B 3/244; A43B 3/248; A43B 1/0063; A43B 7/144; A43B 7/1463; A43B 23/08; A43B 23/088

(Continued)

(56) References Cited

U.S. PATENT DOCUMENTS

| | | | |
|---|---|---|---|
| 48,614 | A | 7/1865 | Ballou |
| 1,228,720 | A | 6/1917 | Troutt |

(Continued)

FOREIGN PATENT DOCUMENTS

| | | | |
|---|---|---|---|
| CN | 2042302 | U | 8/1989 |
| CN | 2070557 | U | 2/1991 |

(Continued)

OTHER PUBLICATIONS

International Preliminary Report on Patentability received for PCT Patent Application No. PCT/US2020/042520, mailed on Jan. 27, 2022, 10 pages.

(Continued)

*Primary Examiner* — Marie D Bays

(74) *Attorney, Agent, or Firm* — Smith, Gambrell & Russell, LLP; Michael J. Riesen; Indhira LaPuma

(57) ABSTRACT

A separable footwear article comprising an outsole oriented at a bottom of the footwear and configured for ground contact, the outsole comprising a first material, an upper portion comprising a second material different from the first material, and a welt positioned between the outsole and the upper. The welt is releasably coupled to the outsole with a first thread using a first stitching technique, and releasably coupled to the upper portion with a second thread using a second stitching technique. The outsole, the upper portion, and the welt are configured to be separated upon receipt of a pulling force upon the first thread and the second thread sufficient to remove the first thread and the second thread from the footwear article.

17 Claims, 25 Drawing Sheets

Related U.S. Application Data continuation of application No. 16/931,848, filed on Jul. 17, 2020, now Pat. No. 11,412,809.

(60) Provisional application No. 62/875,090, filed on Jul. 17, 2019.

(58) Field of Classification Search
USPC ..... 36/100, 101, 15
See application file for complete search history.

(56) References Cited

U.S. PATENT DOCUMENTS

| | | | |
|---|---|---|---|
| 1,675,711 | A | 7/1928 | Jones |
| 1,714,271 | A | 5/1929 | Kelly |
| 1,808,992 | A | 6/1931 | Langdon |
| 1,946,591 | A | 2/1934 | Tomosaburo |
| 2,119,392 | A | 5/1938 | Levin |
| 2,438,711 | A | 3/1948 | Leach et al. |
| 3,821,827 | A | 7/1974 | Nadler |
| 4,156,947 | A | 6/1979 | Nadler |
| 4,869,001 | A | 9/1989 | Brown |
| 4,974,344 | A | 12/1990 | Ching |
| 5,083,385 | A | 1/1992 | Halford |
| 5,799,417 | A | 9/1998 | Burke et al. |
| 6,023,857 | A | 2/2000 | Vizy et al. |
| 6,023,859 | A | 2/2000 | Burke et al. |
| 6,408,543 | B1 | 6/2002 | Erickson et al. |
| 6,467,116 | B1 | 10/2002 | Strickland |
| 6,536,137 | B1 | 3/2003 | Celia |
| 7,987,617 | B2 | 8/2011 | Kohatsu et al. |
| 8,051,581 | B2 | 11/2011 | Aveni |
| 11,412,809 | B2 | 8/2022 | Lai et al. |
| 2005/0188562 | A1 | 9/2005 | Clarke et al. |
| 2005/0262728 | A1 | 12/2005 | Robbins |
| 2006/0059726 | A1 | 3/2006 | Song et al. |
| 2007/0294922 | A1 | 12/2007 | Ma et al. |
| 2009/0119950 | A1 | 5/2009 | Kohatsu et al. |
| 2009/0313851 | A1 | 12/2009 | Spinelli |
| 2010/0088927 | A1 | 4/2010 | Spinelli |
| 2010/0186255 | A1 | 7/2010 | Avar et al. |
| 2010/0236098 | A1 | 9/2010 | Morgan |
| 2013/0104419 | A1 | 5/2013 | Horesh et al. |
| 2016/0331064 | A1 | 11/2016 | Kawakami |
| 2019/0116936 | A1 | 4/2019 | Aceves et al. |
| 2019/0297988 | A1 | 10/2019 | Oden et al. |
| 2020/0128906 | A1 | 4/2020 | Fossum et al. |
| 2020/0268100 | A1 | 8/2020 | Bramani |
| 2021/0015202 | A1 | 1/2021 | Lai et al. |
| 2022/0408873 | A1* | 12/2022 | Lai ..... A43B 23/0295 |

FOREIGN PATENT DOCUMENTS

| | | | |
|---|---|---|---|
| CN | 101836778 | A | 9/2010 |
| DE | 1675599 | U | 4/1954 |
| DE | 0949721 | C | 9/1956 |
| EP | 0774216 | A1 | 5/1997 |
| EP | 1103197 | A2 | 5/2001 |
| FR | 0850200 | A | 12/1939 |
| FR | 1323629 | A | 4/1963 |
| GB | 0410772 | A | 5/1934 |
| GB | 0450702 | A | 7/1936 |
| GB | 0484517 | A | 5/1938 |
| GB | 0736421 | A | 9/1955 |
| TW | 200614932 | A | 5/2006 |

OTHER PUBLICATIONS

International Search Report and Written Opinion received for PCT Patent Application No. PCT/US20/042520, mailed on Sep. 17, 2020, 16 pages.

Non-Final Office Action received for U.S. Appl. No. 16/931,848, mailed on Dec. 20, 2021, 8 pages.

Notice of Allowance and Fees Due (PTOL-85) received for U.S. Appl. No. 16/931,848, mailed on Apr. 12, 2022, 5 pages.

Office Action received for Chinese Patent Application No. 202080051200.3, mailed on May 27, 2024, 7 pages (4 pages of English Translation and 3 pages of Original Document).

* cited by examiner

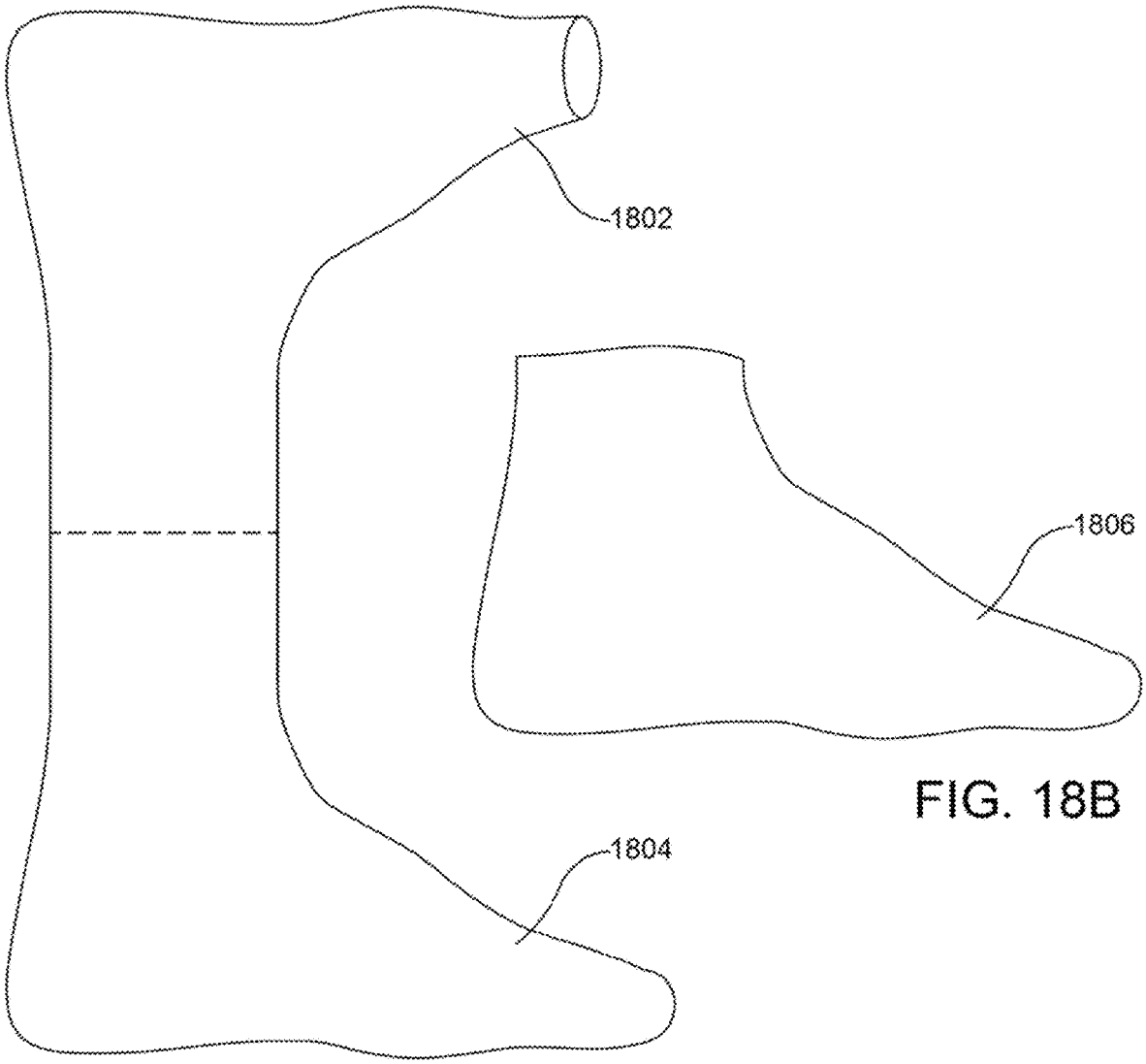
FIG. 18B
FIG. 18A
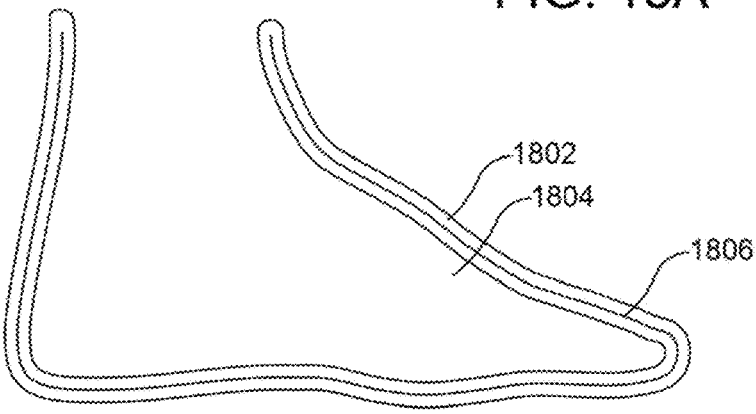
FIG. 18C

SEPARABLE AND REGENERATIVE FOOTWEAR

CROSS REFERENCE TO RELATED APPLICATIONS

This application is a Continuation-in-Part of U.S. Nonprovisional application Ser. No. 17/862,115, filed Jul. 11, 2022, which is a Continuation of Nonprovisional application Ser. No. 16/931,848, filed Jul. 17, 2020, and issued as patent Ser. No. 11,412,809 on Aug. 16, 2022, which is a Nonprovisional of and claims the benefit of U.S. Provisional Application No. 62/875,090 filed Jul. 17, 2019, which are each hereby incorporated by reference in their entirety.

FIELD OF THE DISCLOSURE

The present disclosure generally relates to the field of footwear, and more particularly to articles and methods relating to separable footwear.

BACKGROUND

Conventional articles of athletic footwear generally include at least two components, namely, an upper and a sole structure. The upper is often secured to the sole structure and forms a void on the interior of the footwear for securely and comfortably receiving a foot.

The upper and sole structure of most conventional articles of footwear are permanently secured together through adhesive bonding or stitching, for example.

Accordingly, wear or damage occurring to either the upper or sole structure may require that the entire article of footwear be discarded. In addition, sole structures are generally configured for use during specific activities, particularly with athletic footwear. For example, a sole structure may incorporate pronation control elements that are beneficial for running, stability elements for court-style activities, or relatively soft cushioning for walking. A sole structure that is configured for one athletic activity, such as long-distance running, may not be suitable for use during another athletic activity, such as tennis. Each different type of sole structure, therefore, may require a distinct upper in footwear where the upper and sole structure are permanently secured together.

In contrast with the conventional article of footwear that includes a permanently secured upper and sole structure, footwear configurations embodying an upper and detachable sole structure have been proposed. As an example, U.S. Pat. No. 6,023,857 to Vizy et al. discloses footwear with a permanently attached upper and outsole that includes a separate midsole and heel counter structure, which is removable from the upper. As another example, U.S. Pat. No. 5,083,385 to Halford and U.S. Pat. No. 4,974,344 to Ching both disclose an outsole structure that is detachable from the remainder of the footwear. As a further example, U.S. Pat. Nos. 6,023,859 and 5,799,417 to Burke et al. disclose an article of footwear with removable and exchangeable inserts that are positioned between the upper and a lower portion of the sole structure. The inserts protrude through the lower portion of the sole structure to provide a ground-contacting surface.

However, improvements are needed.

SUMMARY

A separable footwear article may comprise an outsole oriented at the bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are capable of being separated by releasing the thread and hand pulling the thread from the footwear article.

A separable footwear article may comprise: an outsole oriented at the bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are configured to be separated by releasing the thread and pulling the thread from the footwear article.

BRIEF DESCRIPTION OF THE DRAWINGS

The following drawings show generally, by way of example, but not by way of limitation, various examples discussed in the present disclosure. In the drawings:

FIGS. 18A-18C illustrate a knit waterproof bootie construction of an example separable and regenerative footwear article in accordance with the present disclosure.

DETAILED DESCRIPTION

Figure 1:
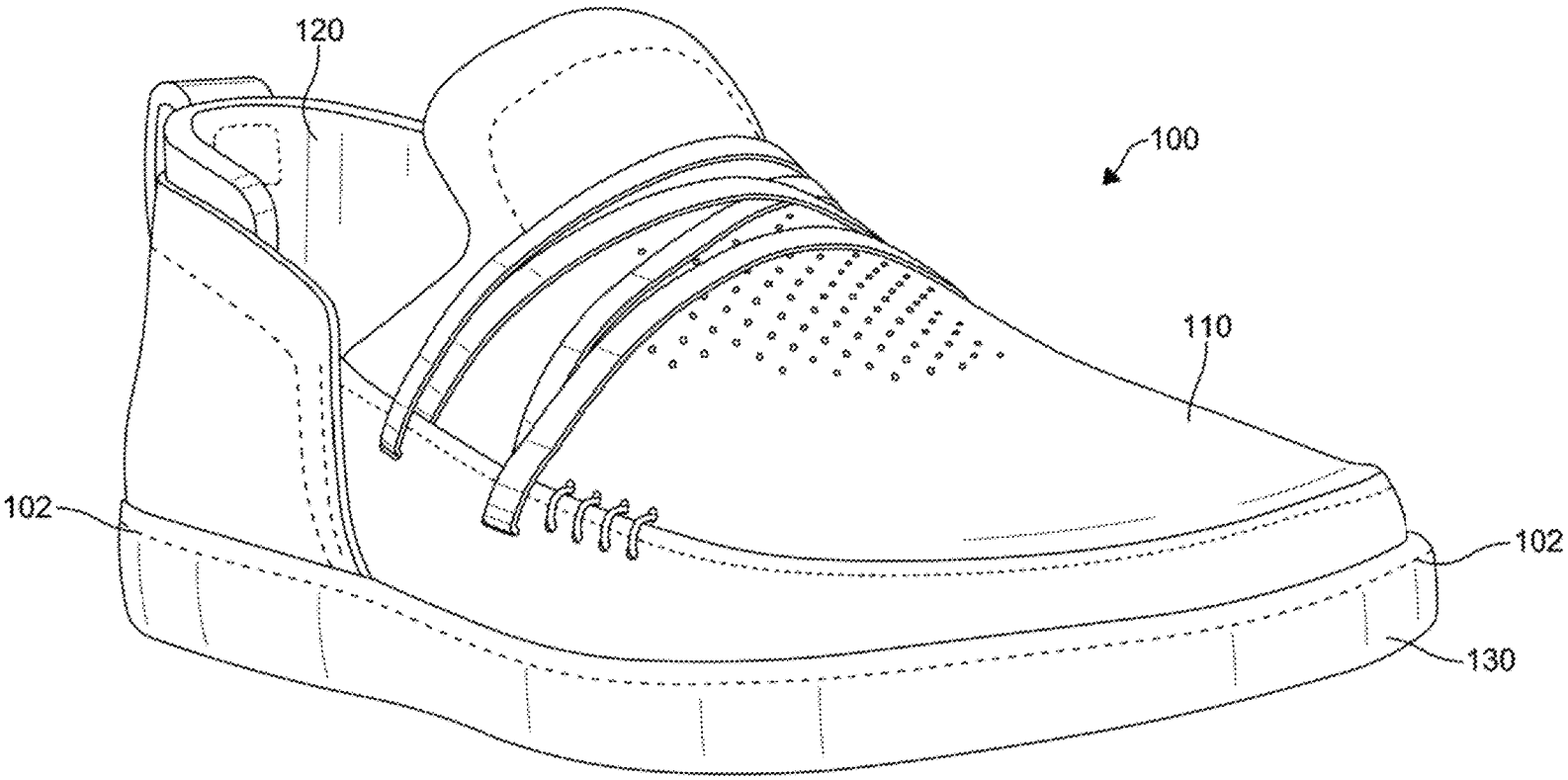
FIG. 1 is a perspective view of a separable and regenerative footwear in accordance with the present disclosure.
Figure 2A:
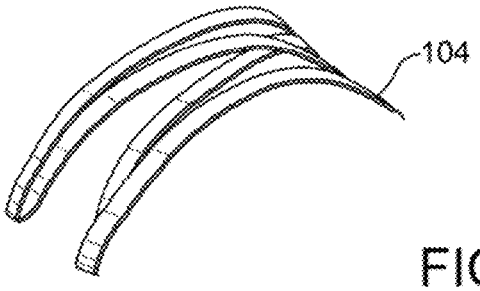
FIGS. 2A-2D illustrate the plurality of components of the separable and regenerative footwear of FIG. 1.
Figure 2B:
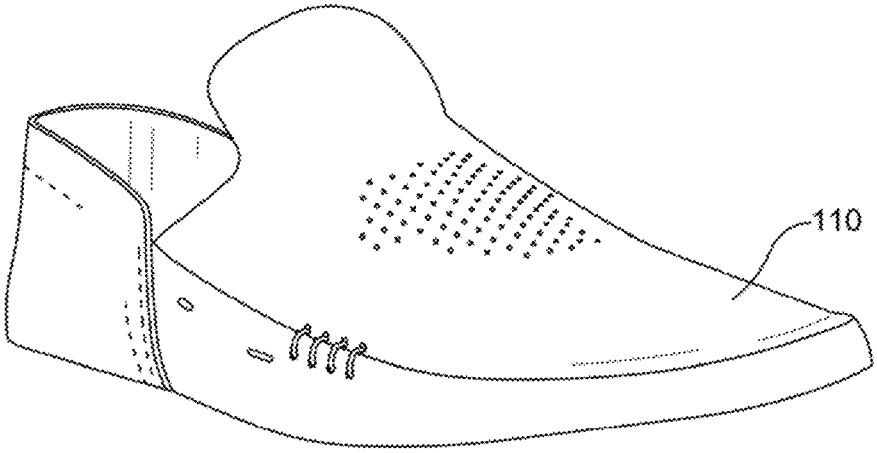
Figure 2C:
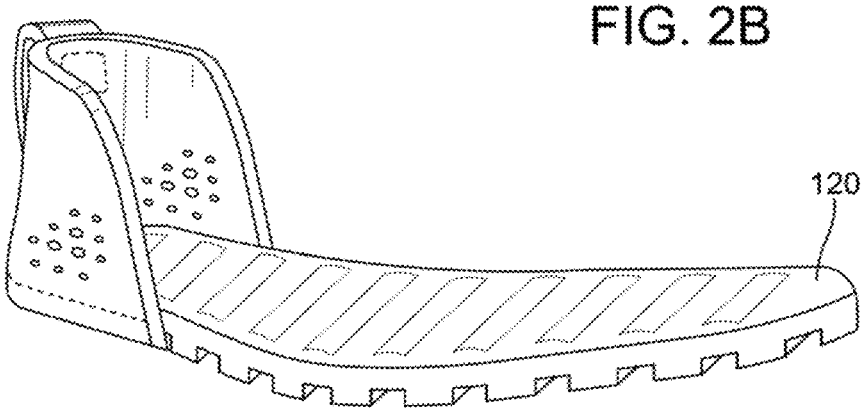
Figure 2D:
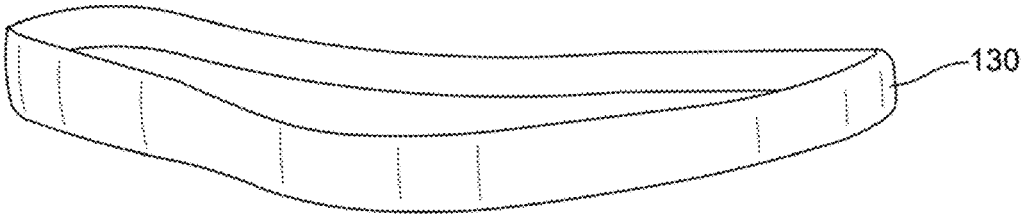

The present disclosure relates to a separable footwear that may comprise a plurality of components coupled to one another, for example, using chain-stitching methods. The footwear may be disassembled with ease by undoing the chain-stitching coupling/holding the components together. One or more of the components of the footwear may comprise a recyclable and/or regenerative material (e.g., regenerative agriculture material such as regenerative rubber, plant material, or plant bi-product material). As used herein, regenerative may reference how the component materials are sourced or produced. Regenerative may comprise materials that are recyclable. Recyclable may include materials that are regenerative. Footwear may comprise a plurality of components made from the same recyclable or regenerative material or from different recyclable or regenerative materials that are coupled to one another with thread using chain-stitching methods and/or lock-stitching methods. The footwear may be disassembled into its component parts. Disassembled components made from like materials may be sorted together and forwarded to a recycling plant or recycling center. Additionally or alternatively, disassembled components may be replaced with different components in a modular manner.

As an example, the components of the footwear may comprise laces, an upper portion, an insole, a midsole and an outsole. The upper portion may be oriented at the top of the assembled footwear and the outsole may be oriented at the bottom of the assembled footwear, and configured for ground contact. The insole may be located in-between the upper portion and the outsole and the midsole may be located in-between the insole and the outsole. The footwear may be assembled with additional components or without all of the listed components present. The components of the footwear may be made from the same material or from different materials. The components of the footwear may be made from the same regenerative material or from different regenerative materials. The components of the footwear may be coupled to one another with thread using chain and/or lock-stitching or other sewing methods that can easily be disassembled.

Coupled components of the footwear may be disassembled by pulling out a loop of the removable stitching that couples the components together, disengaging the thread from the footwear and applying force by tugging sharply on the thread until the coupled components are separated from one another. The method may be repeated to separate other components from one another. As an example, the outsole may be separated from the insole first and then the insole may be separated from the upper portion. The separated components may be sorted for recycling.

The components of the footwear may further comprise a plurality of segments. The segments may be coupled to one another with thread using chain-stitching or other sewing methods (e.g., lock stitching) that can easily be disassembled (i.e., that may be removed upon receipt of a pulling force upon the thread sufficient to remove the thread from the footwear article or component. The segments of the components which are coupled together with thread using such easy-to-remove stitching may further be disassembled into their individual parts. As an example, the upper portion of the footwear may comprise regenerative leather segments coupled together with thread using easy-to-remove stitching which may be disassembled into their individual leather segments and sorted for recycling.

FIG. 1 shows an example separable and regenerative footwear 100 in accordance with the present disclosure. The components may be made from the same regenerative material or different regenerative materials. The components of the footwear 100 may be coupled together with thread using, for example, chain-stitching 102 to form at least a portion of the footwear 100.

As shown in FIGS. 1-2, the footwear 100 may comprise a plurality of separable components. The components of the footwear may be made from the same material or from different materials. The components may be made from the same type of regenerative material or different regenerative materials. The footwear 100 may comprise laces 104, an upper portion 110, an insole 120, and an outsole 130. The upper portion 110, insole 120 and the outsole 130 may be coupled together using chain or lock-stitching methods to form footwear 100.

The upper portion 110 may be removable stitched to the insole 120 and the insole may be removable stitched to the outsole 130. The upper portion 110 may be oriented at the top of the footwear 100, the outsole 130 may be oriented at the bottom of the footwear 100, and the insole 120 may be located in-between the upper portion 110 and the outsole 130.

The laces 104 may be made from plastic such as recycled or regenerative polymers. The laces 104 may comprise or may be formed from cotton such as organic cotton or regenerative cotton. Other materials may be used. The upper portion 110 may be made from leather such as regenerative, recycled, or regenerative leather. The upper portion 110 may comprise or may be formed from polymer (e.g., polyethylene terephthalate PET) or cotton. Other materials may be used. The insole 120 may be made from wool such as biodegradable wool or merino wool. As an example, the insole 120 may have a foam base coupled to a wool heel. Other materials may be used. The outsole 130 may be made from recycled rubber or recycled plastic. The outsole 130 may comprise a foam portion coupled (e.g., stitched) to a rubber base. Other materials may be used.

The footwear 100 may further comprise other components. As an example, the footwear 100 may include a midsole between the insole 120 and the outsole 130. The midsole may be made from regenerative foam or other regenerative material(s).

Figure 3:
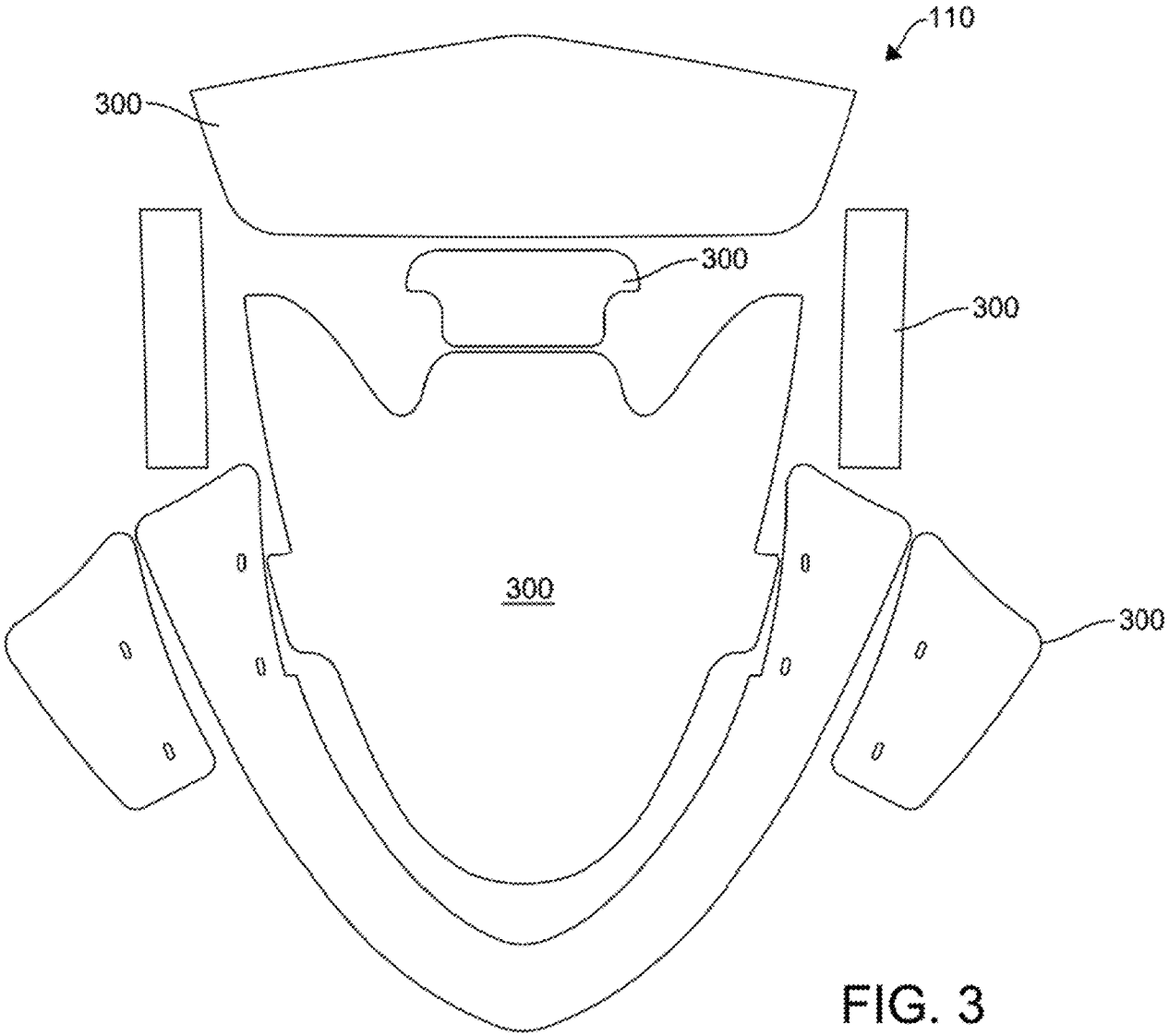
FIG. 3 is an exploded view of the plurality of segments of the upper portion of the separable and regenerative footwear of FIG. 1.

The separable components of the footwear 100 may further comprise a plurality of segments made from the same material or different materials. As an example, the upper portion 110 may comprise a plurality of separable segments (e.g., patterns) made from the same type of regenerative material or different types of regenerative materials (e.g. leather, PET, PET canvas). The upper portion 110 may comprise a plurality of segments made from the same type of regenerative leather or different types of regenerative leather. The plurality of separable segments of the upper portion 110 may be coupled together using removable-stitching methods. FIG. 3 shows an exploded view of the plurality of segments 300 of the upper portion 110 of the footwear 100. The segments 300 may be coupled together using removable-stitching methods or other methods. Alternatively, the upper portion 110 may be formed from a unitary piece (e.g., pattern) formed from the same material (e.g., regenerative materials described herein), such as illustrated in FIGS. 6A-6D. Such a unitary piece may undergo various flat operations prior to be formed (e.g., lasted) into a shape for coupling to an outsole (e.g., outsole 130).

Figure 4:
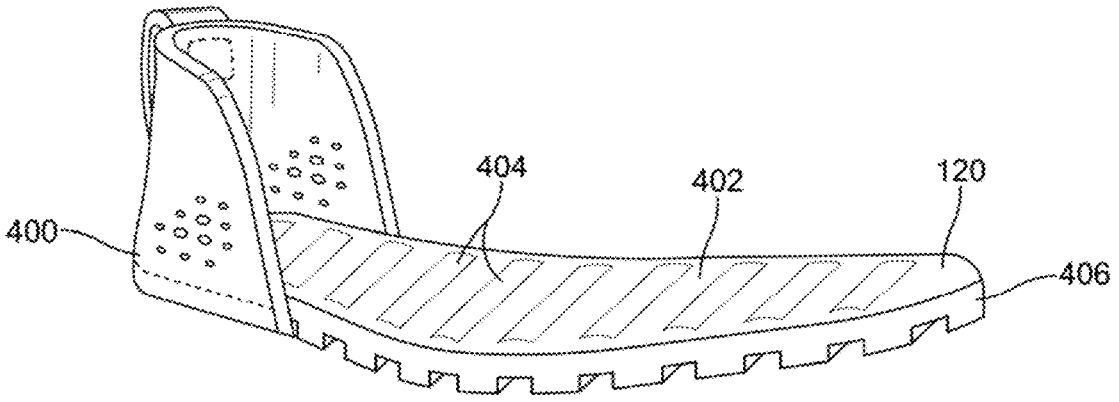
FIG. 4 illustrates an example insole in accordance with the present disclosure.

The insole 120 may further comprise a plurality of segments made from the same type of regenerative material or different types of regenerative materials. As an example, as shown in FIG. 4, the insole 120 may comprise a heel portion 400 and a base 406. The base 406 may further comprise an inner cushion 404 and an outer support 402. As an example, the heel 400 may be made from regenerative wool, the inner cushion 404 may be made from regenerative wool and the outer support 402 may be made from foam. The inner cushion 404 may have ridges and the outer support 402 may have grooves corresponding to the ridges of the inner cushion 404 in order to support the wearer's foot. As a further example, the base 406 may comprise a cover layer (not shown) that may be coupled to the upper, such as via stitching (e.g., chain stitching, lock stitching, etc.). The cover layer may be formed from various materials such as wool, for example.

Figure 5A:
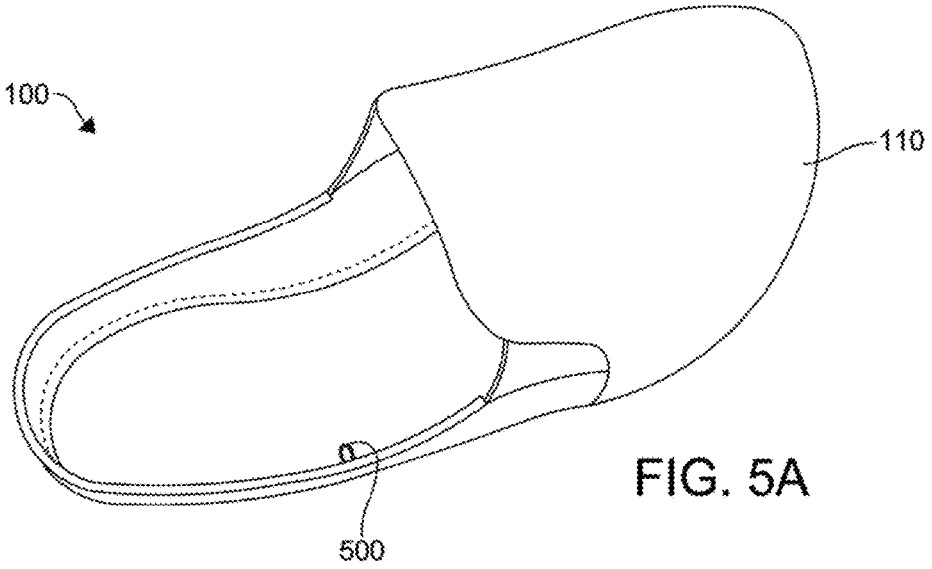
FIGS. 5A-5C illustrate a method of disassembling the separable and regenerative footwear of FIG. 1 in accordance with the present disclosure.
Figure 5B:
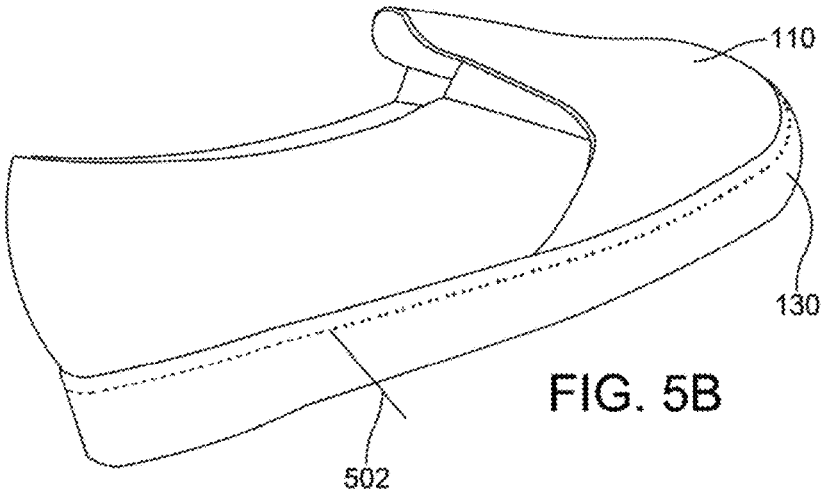
Figure 5C:
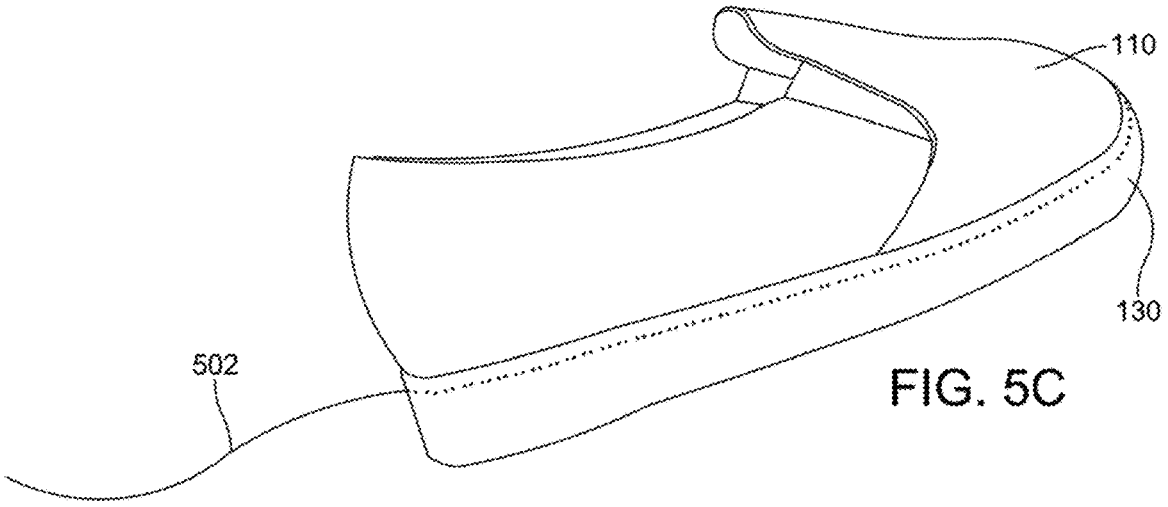
Figure 6A:
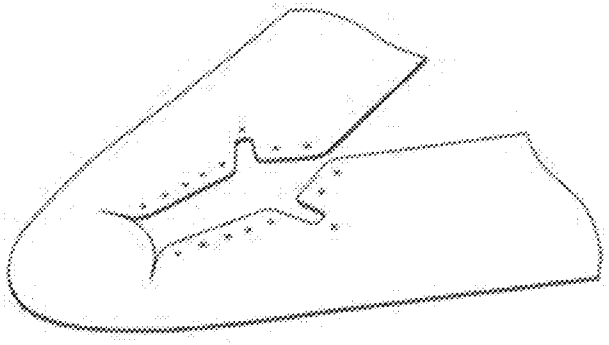
FIGS. 6A-6D illustrate example unitary patterns for a footwear upper.
Figure 6B:
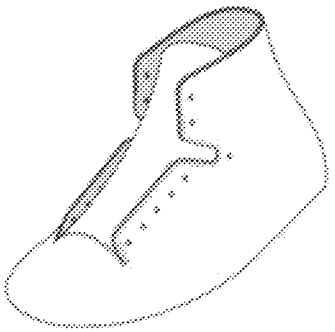
Figure 6C:
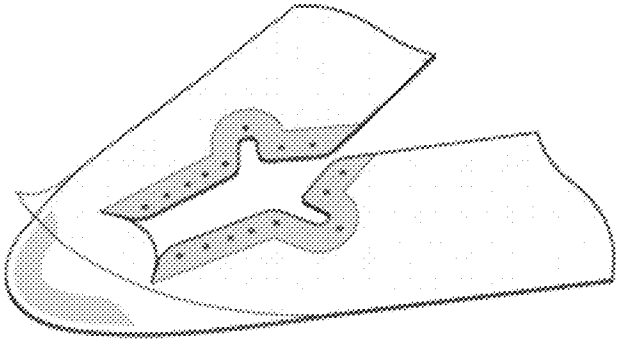
Figure 6D:
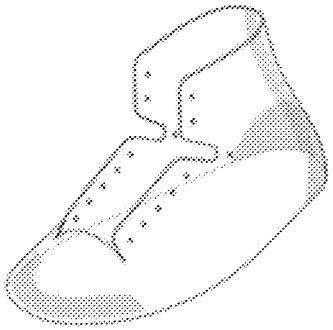

FIGS. 5A-5C illustrate a method of disassembling the footwear 100 in accordance with the present disclosure. FIG. 5A shows a loop of the chain-stitching that couples the outsole 130 to the upper portion 110 of the footwear. To disassemble the footwear 100, the loop of the chain-stitch 500 is pulled out/released, disengaging the thread 502 from the footwear 100 as shown in FIG. 5B. As used herein, releasing a thread may comprise loosening, cutting, or otherwise separating the thread from a stitched surface. Thereafter, force is applied to draw the thread 502 away from the footwear, separating the footwear 100 into its different components. In FIG. 5C, force is applied to draw out the thread 502 that couples the upper portion 110 to the outsole 130 of the footwear 100. Another loop of the chain-stitch thread 502 may be selected and the process repeated until the footwear is disassembled into its component parts. Like regenerative materials may be sorted together and sent to a recycling plant or center. The segments of the components may be further disassembled using the same method or similar methods.

When a chain stitch is used, various chain-stitching machines may be used. As an example, a single thread chain-stitch seated type shoe border sewing machine (e.g., manufactured by Semlima) may be used.

Various stitch patterns may be used. As an example, 4-5 stitches may be used per inch. As an illustrative example, overlapping stitches (e.g., 6, 5, 3, etc.) may be used on at least the stitching start and ending area. Such overlapping stitching may improve the coupling strength on the subject area. Alternatively or additionally, after the stitching of the upper to the outsole is complete, an end of the stitching thread may be cut. The end (cut or uncut) may be inserted into a stitch hole (e.g., an adjacent stitch hole). An adhesive, such as glue may be disposed (e.g., injected) at the stitch hole to fix the end of the thread in place. Alternatively or additionally, an end of the thread may extend toward in inside of area of the footwear, where an insole may be disposed. As such, the end of the thread on the inside may be sealed in position, for example, using a hot melt and a stamp over the thread to secure the thread to the inside of the footwear.

Various threads for stitching may be used. As an example, 1.0 mm polyester braid may be used.

Various components such as the upper and the sole may be temporarily coupled to hold a position for stitching. As an example, a temporary cement (e.g., yellow glue code 766N by Nanpao) may be used to temporarily couple components.

Figure 7C:
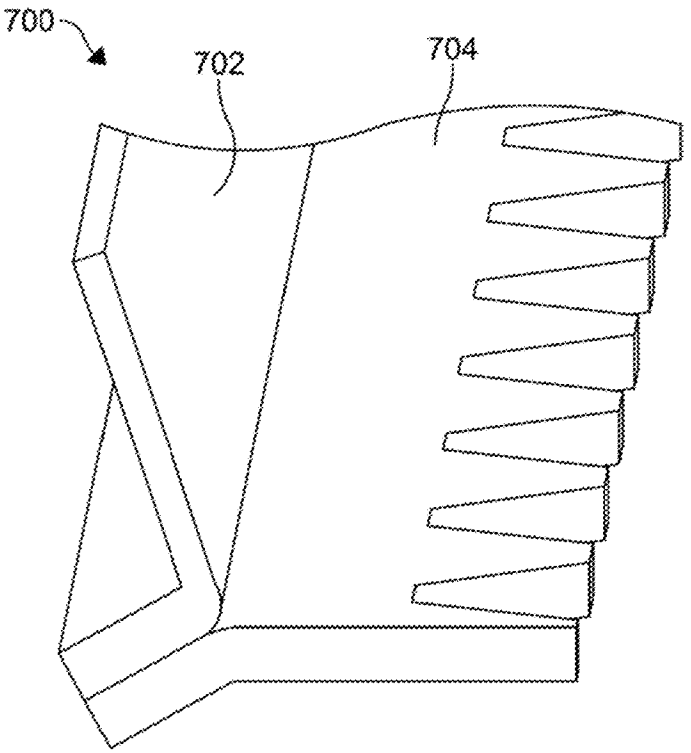
FIGS. 7A-7C illustrate an example welt in accordance with the present disclosure.
Figure 7B:
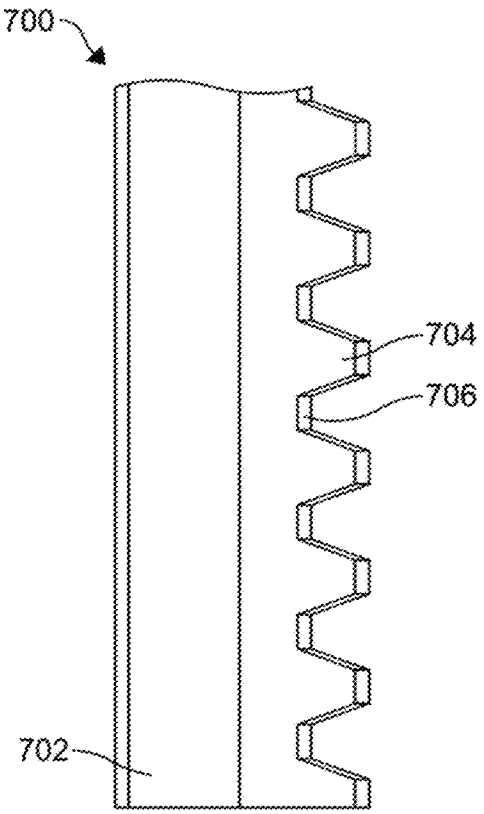
Figure 7A:
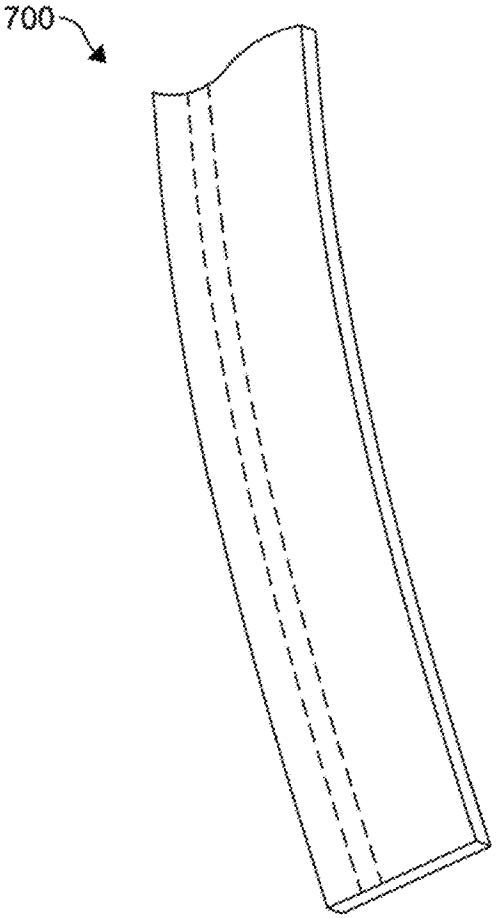

Additionally or alternatively, articles and/or methods in accordance with the present disclosure may comprise a welt 700, for example, as illustrated in FIGS. 7A-7C. The welt 700 may be formed from various materials including leather, regenerative leather, and/or other regenerative materials. As shown, the welt 700 may be split from a center or near a center to define a generally Y-shaped cross section. As such, one branch 702 may be coupled (e.g., chain stitched, lock stitched, etc.) to an upper and the other branch 704 may be coupled (e.g., chain stitched, lock stitched, etc.) to an outsole. As shown, at least one of the branches 702, 704 may comprise notches 706 or indentations to provide freedom of movement.

Figure 14:
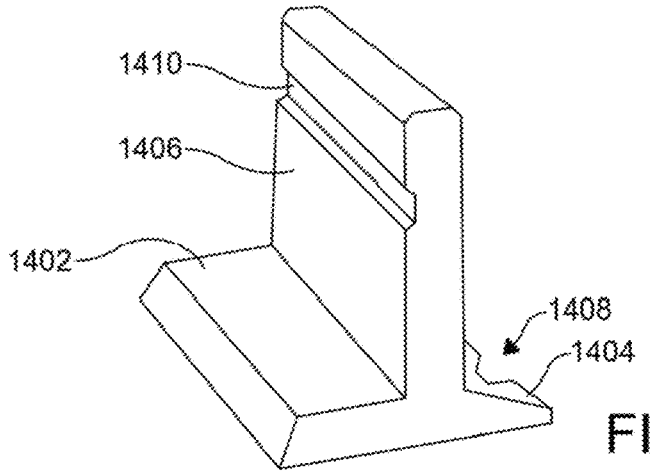
FIG. 14 illustrates an example welt in accordance with the present disclosure.

Additionally or alternatively, articles and/or methods in accordance with the present disclosure may comprise a T-shaped welt 1400, for example, as illustrated in FIG. 14. The welt 1400 may be formed from various materials including leather, regenerative leather, and/or other regenerative materials. As shown, the welt 1400 may be split from a center or near a center to define a generally T-shaped cross section, and may comprise a plurality of branches (e.g., branches 1402, 1404) and an elongate body 1406. As such, one branch 1402 may be coupled (e.g., chain stitched, lock stitched, etc) to an upper and the other branch 1404 may be coupled (e.g., chain stitched, lock stitched, etc) to an outsole. As shown, at least one of the branches 1402, 1404 may comprise notches 1406 or indentations to provide freedom of movement. The elongate body 1406 may further comprise a groove 1410 configured to receive one or more additional footwear article components.

Figure 8:
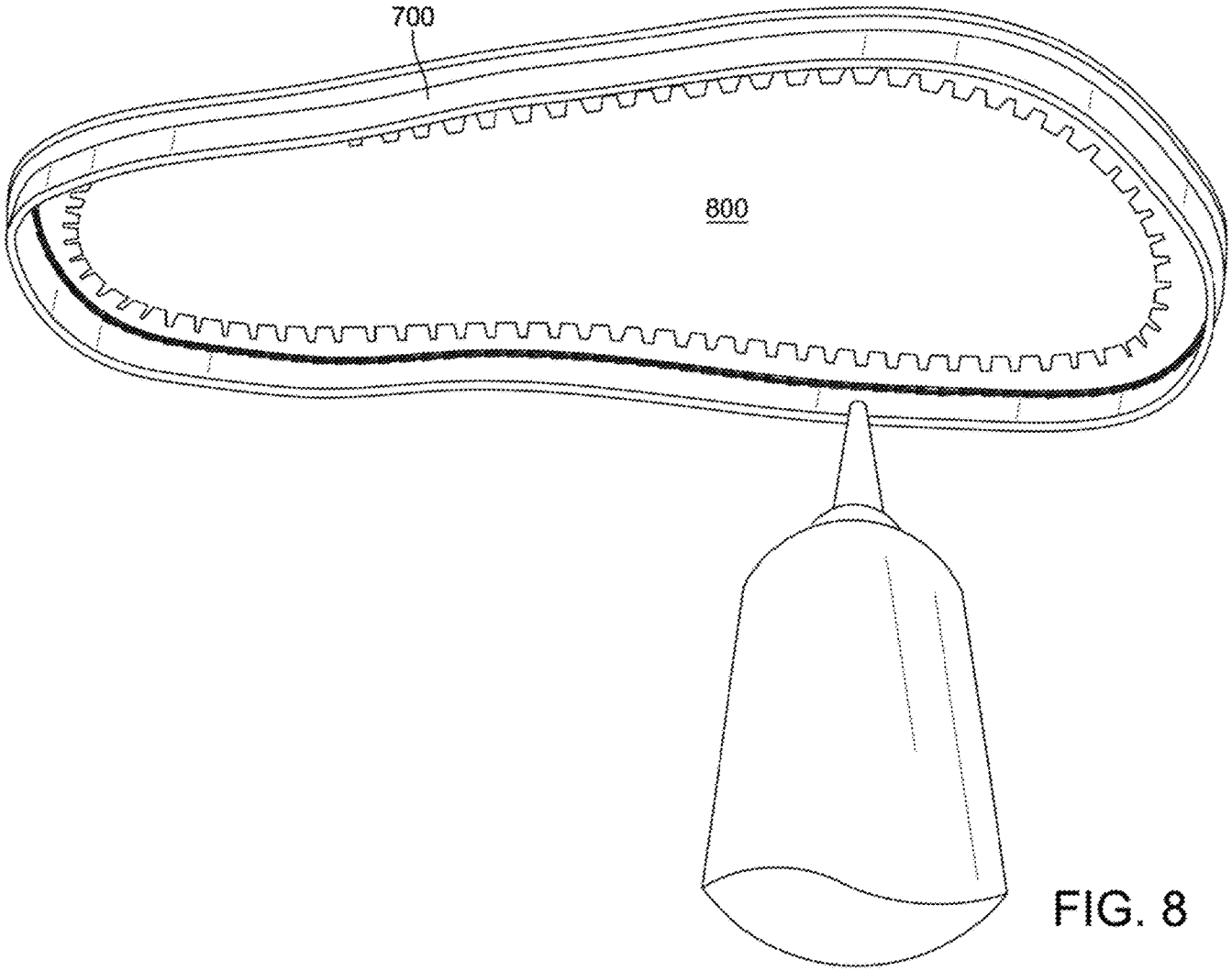
FIG. 8 illustrates an example method in accordance with the present disclosure.
Figure 9:
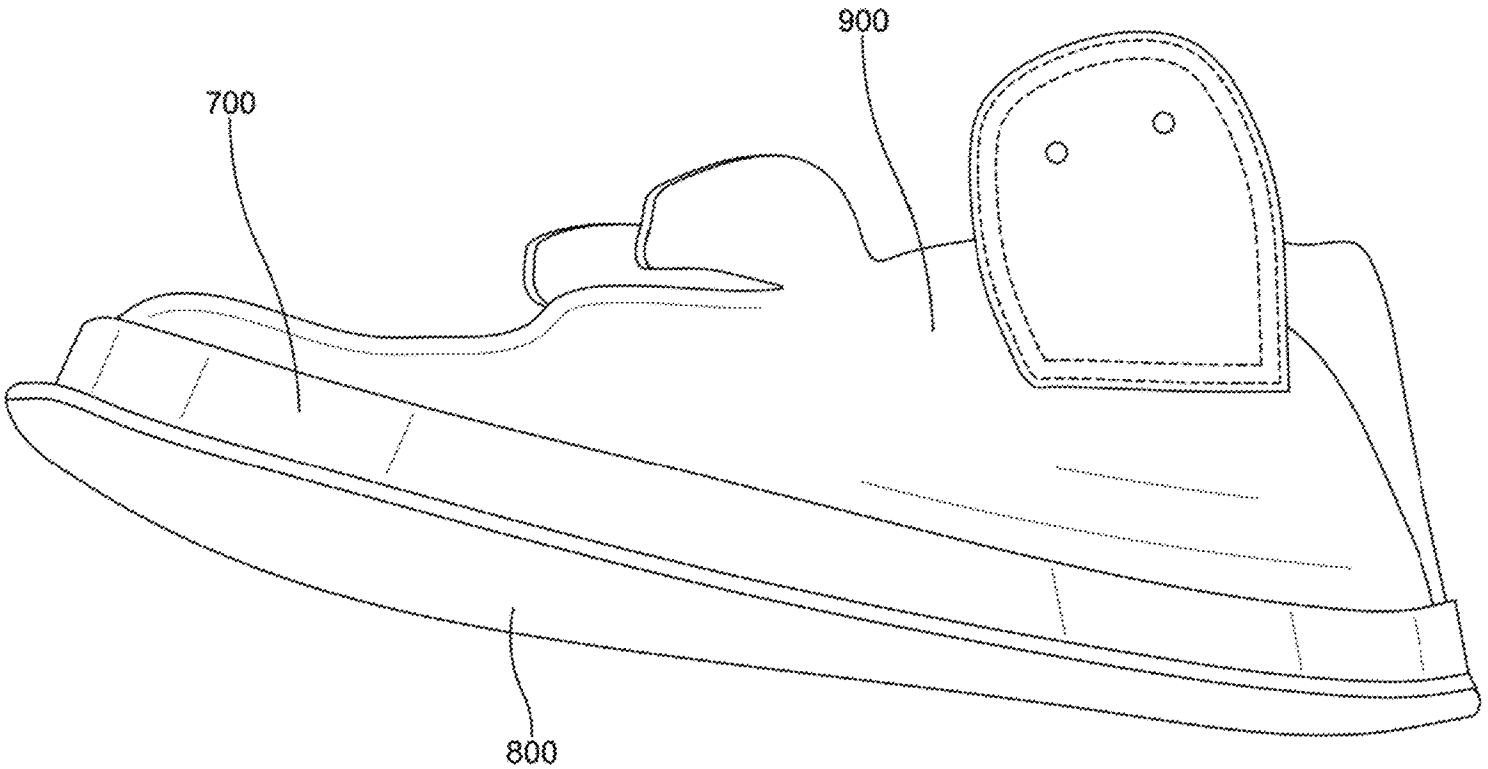
FIG. 9 illustrates an example method in accordance with the present disclosure.

A method in accordance with the present disclosure may comprise a method of making footwear that is configured to disassembly, for example, to be recycled into component parts. The method may comprise applying a temporary adhesive to at least a portion of the welt 700 and coupling the welt 700 to an outsole 800, as shown in FIG. 8. The method may comprise applying a temporary adhesive to at least a portion of the welt 700 and coupling the welt 700 to an upper 900, as shown in FIG. 9. As illustrated in FIG. 9, the welt 700 may be coupled to the outsole 800 and while coupled to the outsole 800, may be coupled to the upper 900. Other process steps and ordering of steps may be used.

Figure 10:
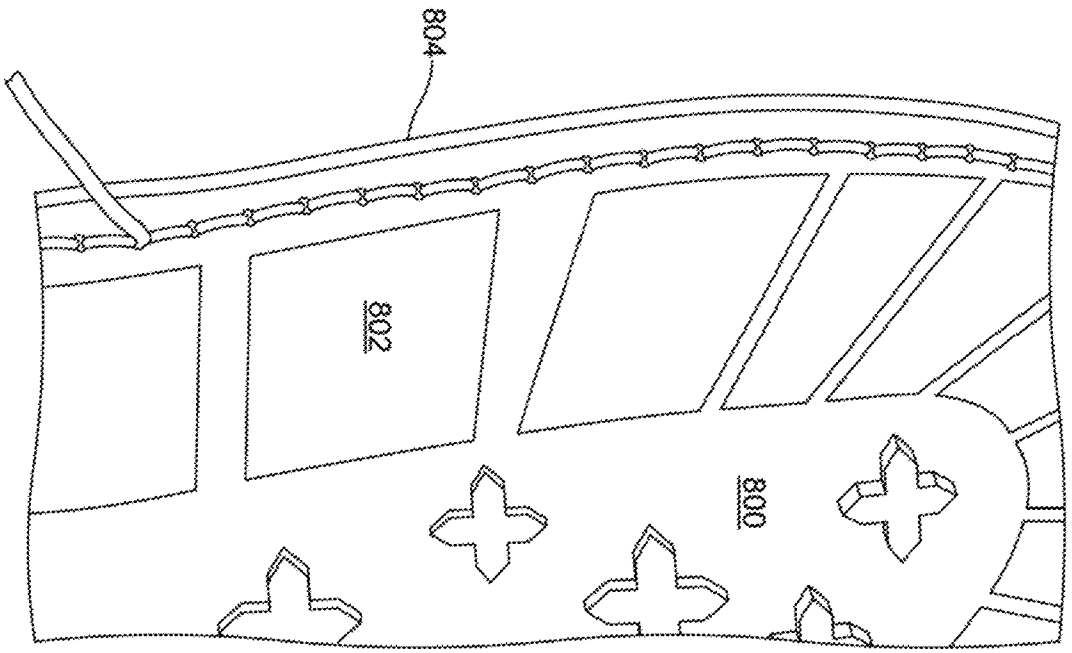
FIG. 10 illustrates an example method in accordance with the present disclosure.

FIG. 10 illustrates chain stitching of the welt 700 and the outsole 800. The welt 700 and the outsole 800 may first be temporarily coupled using an adhesive to hold a position for stitching. However, other steps or process including not using temporary adhesive may be used. As shown, the stitching may be through a bottom surface 802 of the outsole 800 and may be disposed adjacent a peripheral edge 804 of the outsole 800.

Figure 11A:
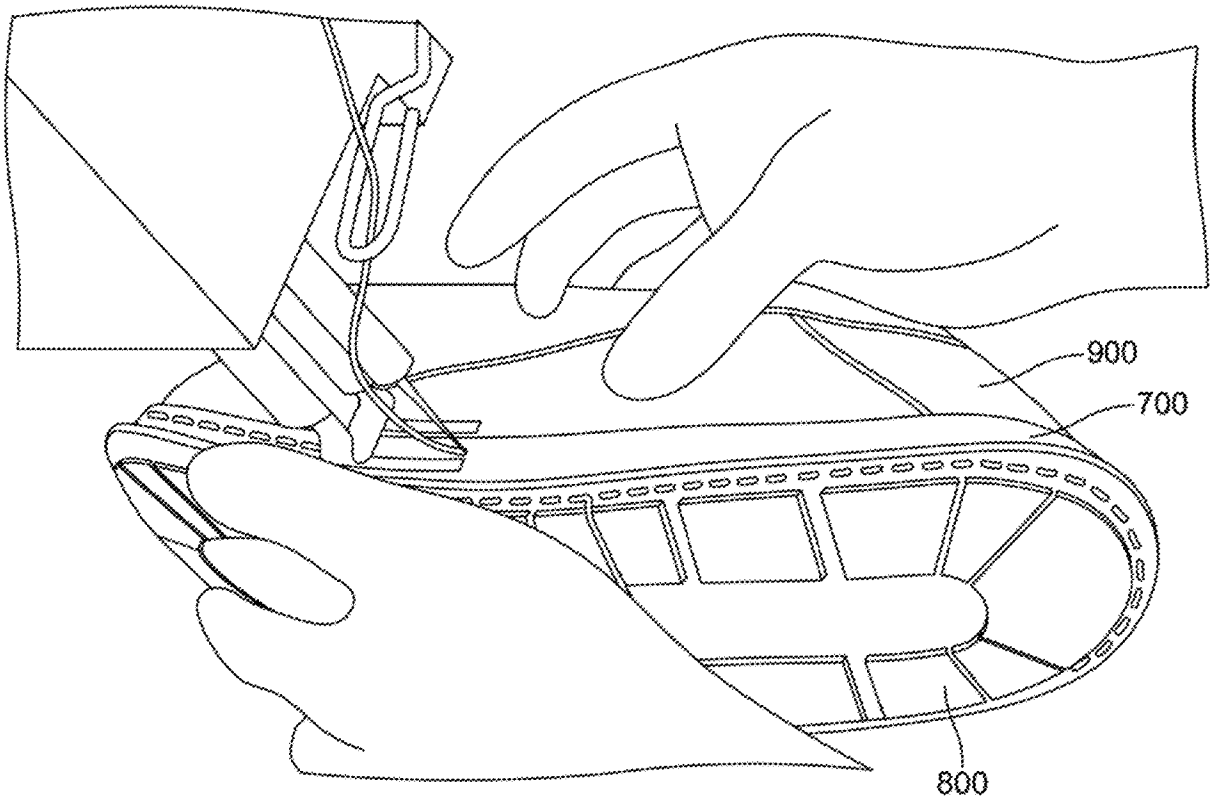
FIGS. 11A-11C illustrate an example method in accordance with the present disclosure.
Figure 11C:
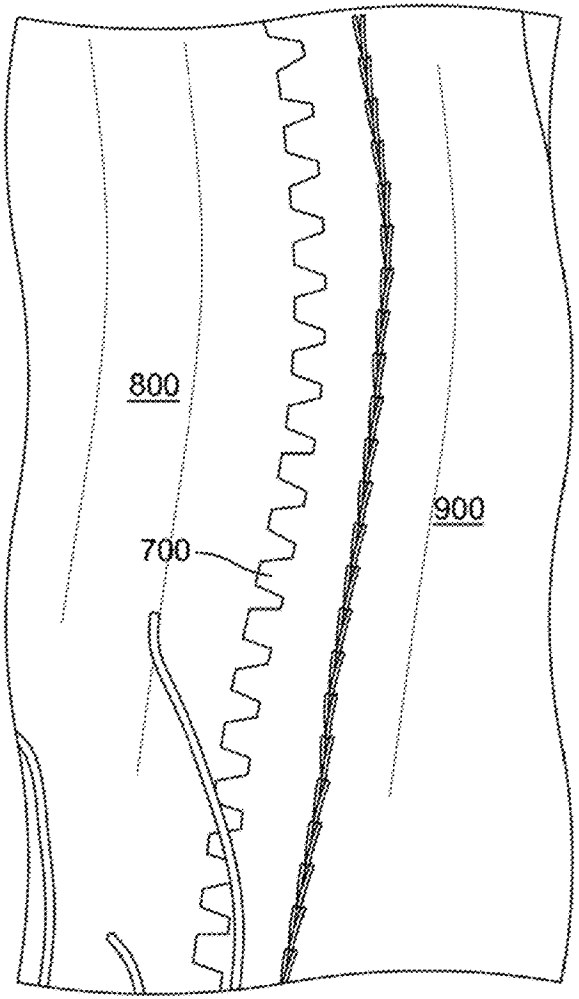
Figure 11B:
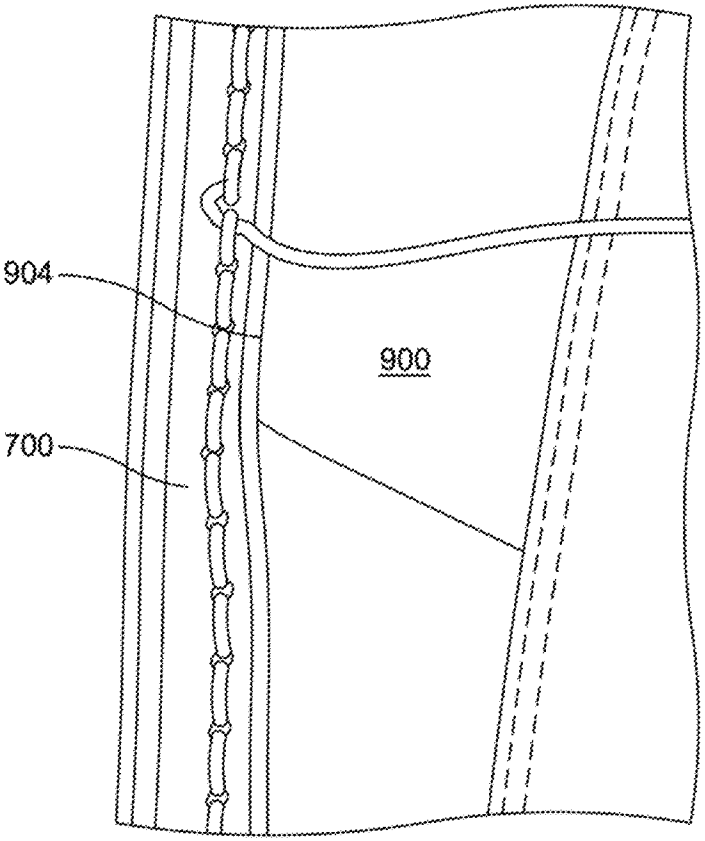

FIGS. 11A-11B illustrate chain stitching of the welt 700 and the upper 900. The welt 700 and the upper 900 may first be temporarily coupled using an adhesive to hold a position for stitching. However, other steps or process including not using temporary adhesive may be used. As shown, the stitching may be disposed adjacent a peripheral edge 904 of the upper 900.

Figure 12:
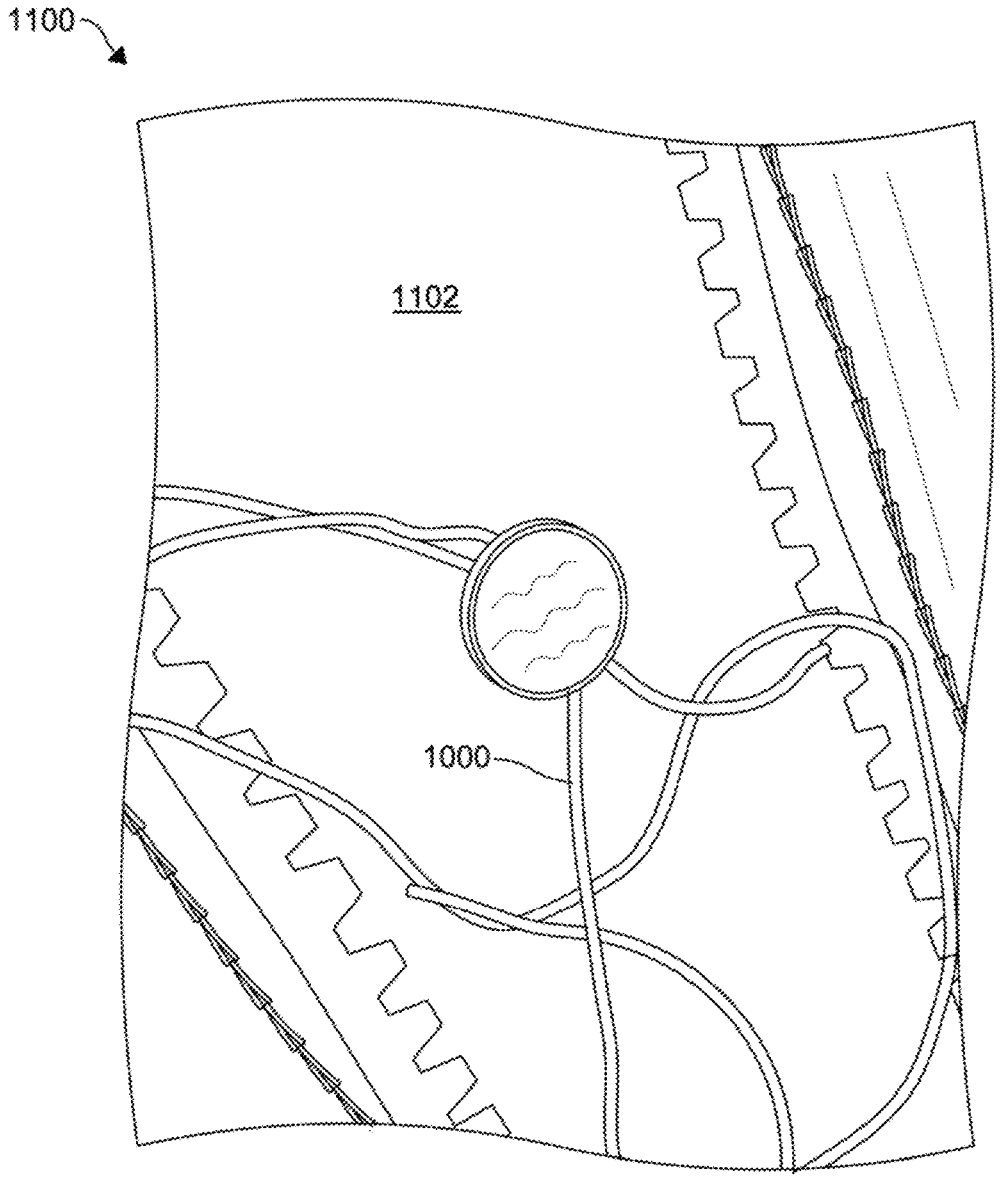
FIG. 12 illustrates an example method in accordance with the present disclosure.
Figure 13:
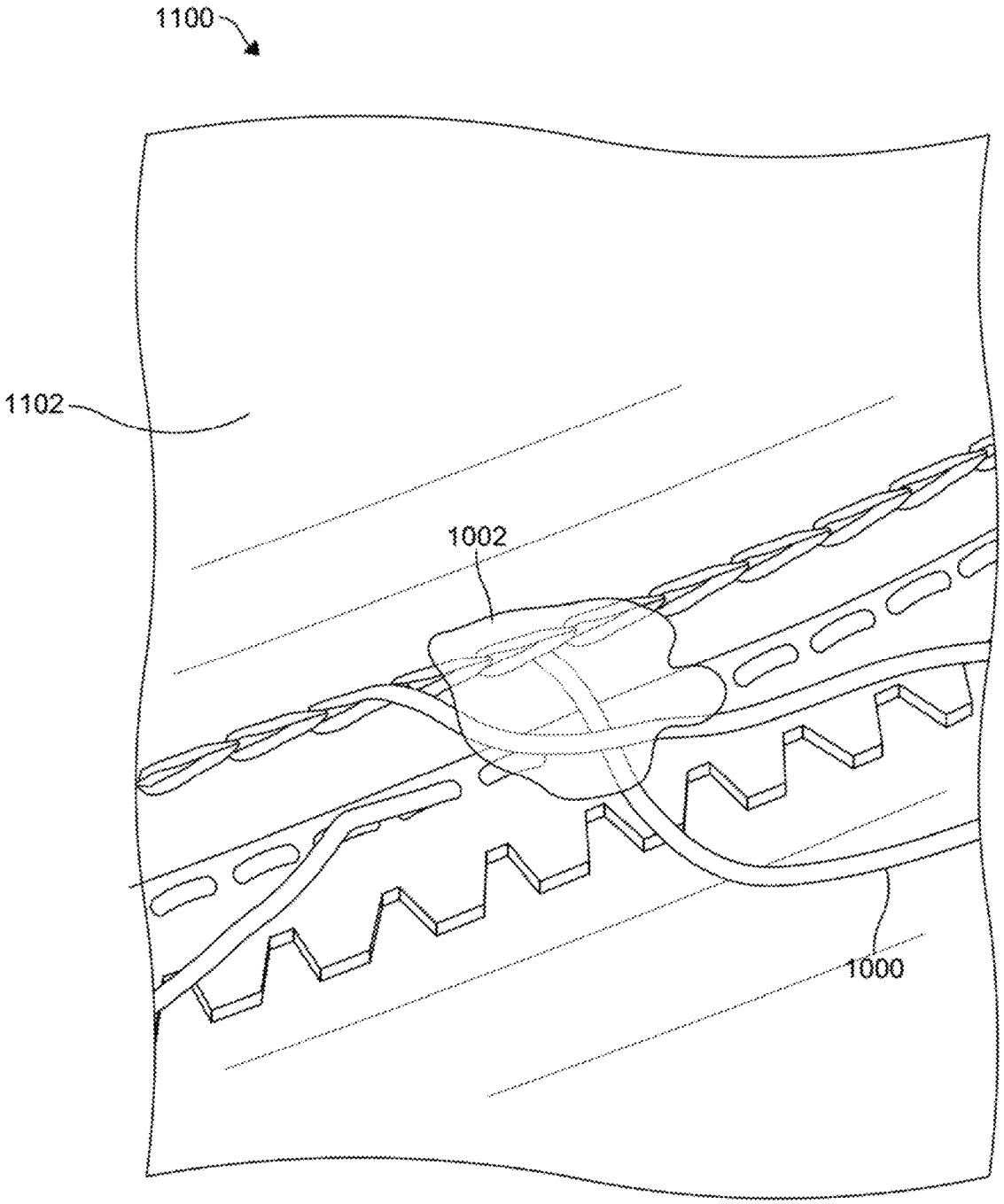
FIG. 13 illustrates an example method in accordance with the present disclosure.

Ends of the thread used for chain stitching may be disposed on an outside of the upper 900 when the stitching is initially complete. As shown in FIG. 12, thread 1000 (e.g., thread ends, thread ends pulled from the outside of the upper 900) may be disposed in an interior of the footwear 1100. The threads 1000 may be secured to an interior surface 1102 of the footwear such as an upper side of the outsole 800. Other surfaces may be used. As shown, the threads 1000 may be secured using a wax or other hot melt material. Such a wax may be stamped to further secure the threads and/or to provide ornamental marking. Wax or other materials may be used to seal any stitching hole and/or thread ends 1002, as shown in FIG. 13.

For disassembly of the footwear 1100, the thread ends 1002 may be removed from the seal (e.g., wax) and pulled outside of the footwear 1100. The stitching may be removed from the upper 900 and welt 700 to release the upper 900, for example, by simply pulling the thread 1000 to release the stitches. The stitching may be removed from the outsole 800 and welt 700 to release the outsole 800, for example, by simply pulling the thread 1000 to release the stitches. The upper 900, outsole 800, and welt 700 may be pulled apart for recycling. It is understood that some adhesion of the components may be evident based on the temporary adhesive. However, the nature of the temporary adhesive allows for pulling apart of the components by hand.

Figure 15:
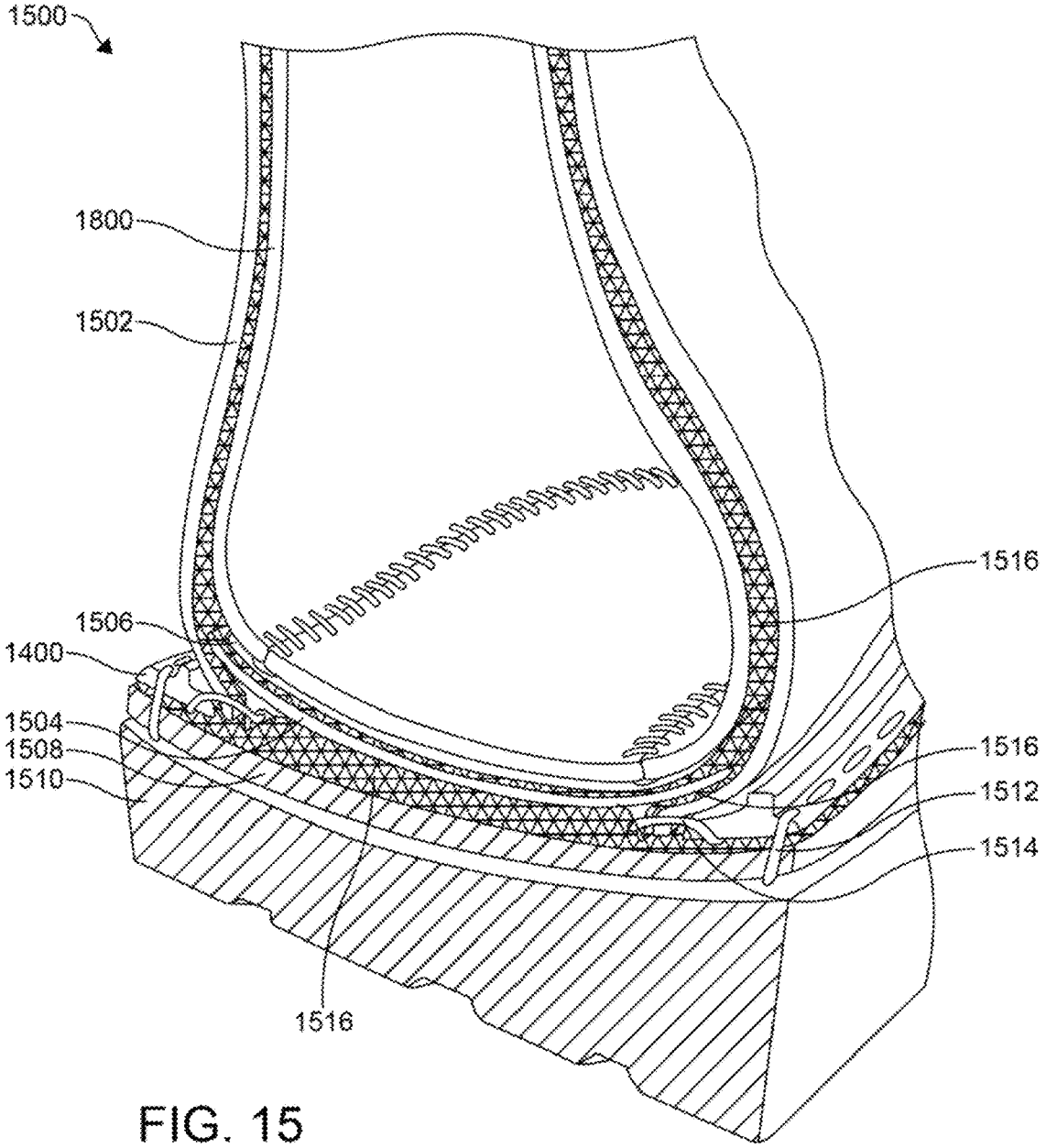
FIG. 15 illustrates a cross-section of an example separable and regenerative footwear article in accordance with the present disclosure.

FIG. 15 illustrates cross-section of an example separable and regenerative footwear article 1500 in accordance with the present disclosure. Footwear article 1500 may comprise a welt 1400 (or, e.g., welt 700), an upper 1502, a welting board 1504, a gasket 1506 (e.g., a bootie gasket), a midsole 1508 (e.g., a rubber or EVA board), and an outsole 1510. A plurality of removable stitches 1512 (e.g., chain stiches, 161 chain stitches, lock stitches, etc.) may be utilized to secure one or more components to one or more other components (e.g., to secure the welt 1400 to the rubber board 1508). A plurality of removable stitches 1514 (e.g., chain stiches, 161 chain stitches, welting stitches, lock stitches, etc.) or staples may be utilized to secure one or more components to one or more other components (e.g., to secure the welt 1400 to upper 1502, the welting board 1504 and/or the rubber board 1508). The upper 1502 may be sewn to the welt or welts that attach to the insole and the outsole. The welt 1400 may be stitched to upper via a Goodyear welt stich, such that the stitch that attaches the outsole to the shoe runs around the outside edge and does not make stitch holes in the upper. The welt 1400 may be stitched to the outsole using a removable stitch (e.g., a chain stitch, lock stitch, etc.). As an example, more or more removable stitches (e.g., chain stiches, 161 chain stitches, welting stitches, lock stitches, etc.) may be used to secure the midsole to the outsole or an upper to a midsole, or other combinations of components to allow easy separation of such components.

The separable and regenerative footwear article 1500 may include a waterproof bootie (e.g., bootie 1800 of FIGS. 18A-18C). Waterproof bootie 1800 may be a knit waterproof bootie.

Various components separable and regenerative footwear article 1500 may be temporarily coupled via a temporary adhesive 1516 to hold a position for stitching. As an example, a temporary cement (e.g., yellow glue code 766N by Nanpao) may be used to temporarily couple components. The temporary adhesive 1516 may be applied to one or more components of the footwear article 1500, for example, between the upper 1502 and the bootie 1800, between the bootie 1800 and the bootie gasket 1506, between the bootie gasket 1506 and the welting board 1504, and/or between the welting board 1504 and the rubber board 1508.

Figure 16:
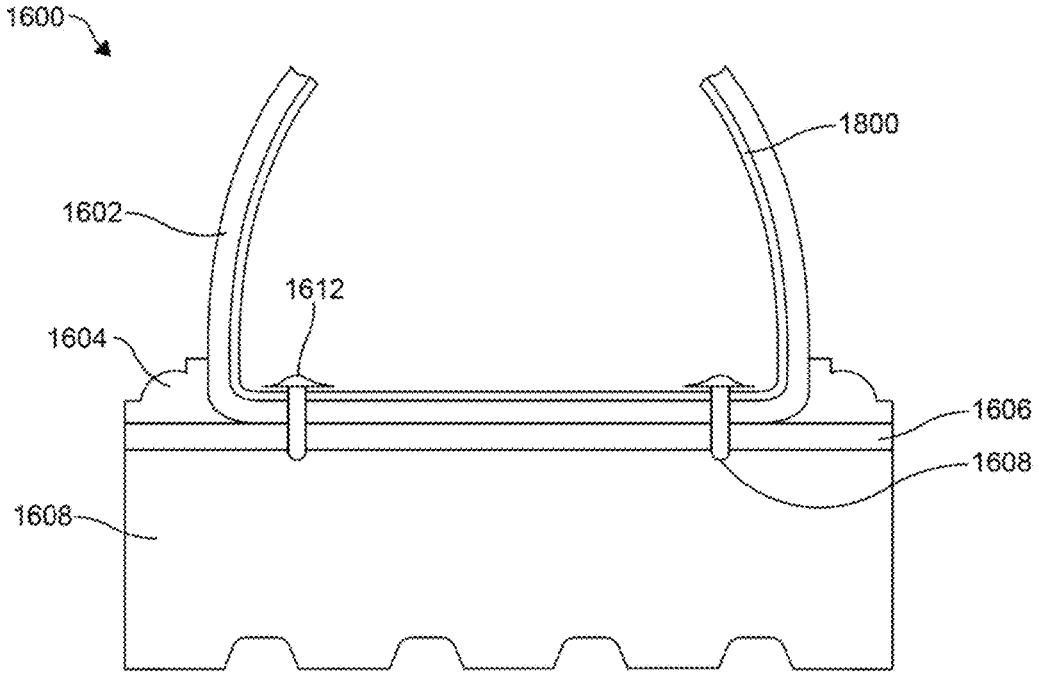
FIG. 16 illustrates a cross-section of an example separable and regenerative footwear article in accordance with the present disclosure.

FIG. 16 illustrates a cross-section of an example separable and regenerative footwear 1600 article in accordance with the present disclosure. Footwear article 1600 may comprise a welt (e.g., welt 1400 as described in FIG. 14), an upper 1602, a welt 1604, a rigid or rubber board 1606, and an outsole 1608. A plurality of removable stitches (e.g., chain stiches, 161 chain stitches, lock stitches, etc.) may be utilized to secure one or more components to one or more other components (e.g., to secure the welt 1604 to the rubber board 1606). A plurality of other stitches 1610 (e.g., traditional stitches) or staples may be utilized to secure one or more components to one or more other components (e.g., to secure the upper 1602 to the rubber board 1606 and outsole 1608). The separable and regenerative footwear article 1600 may include a waterproof bootie (e.g., bootie 1800 of FIGS. 18A-18C) that may line the interior of the upper 1602. In the example shown in FIG. 16, Littleway stitches may be used to attach the outsole 1608 to upper 1602 with stitching going through rubber board 1606 and outsole 1608. Waterproof bootie 1800 may be a knit waterproof bootie. The footwear article may further include a seam sealing mechanism 1612 (e.g., seam seal tape) to cover any stich holes made when the upper 1602 and waterproof bootie 1800 are attached to the outsole 1608.

Figure 17:
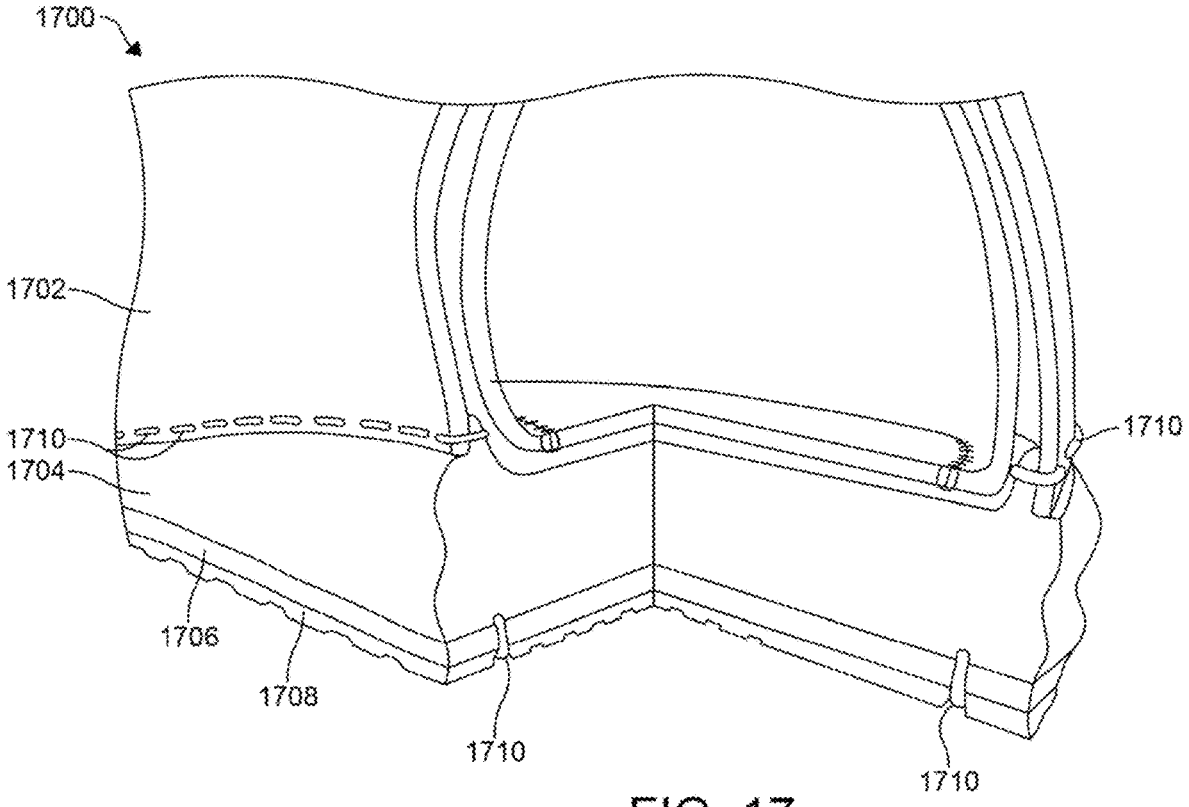
FIG. 17 illustrates a cut-away view of an example separable and regenerative footwear article in accordance with the present disclosure.

FIG. 17 illustrates a cut-away view of an example separable and regenerative footwear article 1700 in accordance with the present disclosure. Footwear article 1700 may comprise an upper 1702, a midsole 1704 (e.g., an EVA foam midsole), a foam board layer 1706 (e.g., EVA layer), and an outsole 1708 (e.g., a rubber outsole). The midsole 1704 may include a flange 1710 or ridge over which the upper can overlap such that a perimeter of the upper adjacent the midsole 1704 abuts the midsole flange 1710. The upper can then be secured to the flange 1710 via a plurality of removable stitches 1710 (e.g., chain stiches, 161 chain stitches, lock stitches, etc.). The separable and regenerative footwear article 1700 may include a waterproof bootie (e.g., bootie 1800 of FIGS. 18A-18C). Waterproof bootie 1800 may be a knit waterproof bootie.

FIGS. 18A-18C illustrate a waterproof bootie 1800 of an example separable and regenerative footwear article in accordance with the present disclosure. The waterproof bootie 1800 may be a knit waterproof bootie. The waterproof bootie 1800 may be formed of waterproof material in a sock shape. The waterproof bootie 1800 may be seamless.

The waterproof bootie 1800 may be a multi-layer bootie comprising inner and outer sock layers 1802, 1804 and an inner waterproof membrane layer 1806. The inner waterproof membrane layer 1806 may be folded into the sock layers such that the waterproof membrane layer 1806 is trapped between the sock layers 1802, 1804. When inserted into or assembled with the footwear article, the waterproof membrane 1806 may be sandwiched between the inner and outer sock layers 1802, 1804 such that a foot of a wearer does not directly contact the waterproof membrane layer 1806.

The sock layers 1802, 1804 may be knit sock layers. Knit sock layers may be circular knit layers. At least one layer may comprise an opening 1808, enabling the sock layer to be folded around the waterproof membrane layer and providing an opening into which a foot may be inserted.

Waterproofing may be based on one or more tests or standards. For example, whole shoe flex-waterproof testing may be based on SATRA™ 77-1992. However, other tests may be used including in-house testing such as immersion tank. As a further example, a waterproof test may comprise removing all tags, laces, and inserts, placing a weight inside the footwear, inserting the footwear into tank, fill tank and then remove footwear and inspect for leaks. Fill line may be 60% of the lowest point on a topline of the footwear or may be set at a predefined level (e.g., 120 mm) A show flexing waterproof test may be used, such as by incorporating a show flexing waterproof tester/machine. Other tests may be used.

Figure 19:
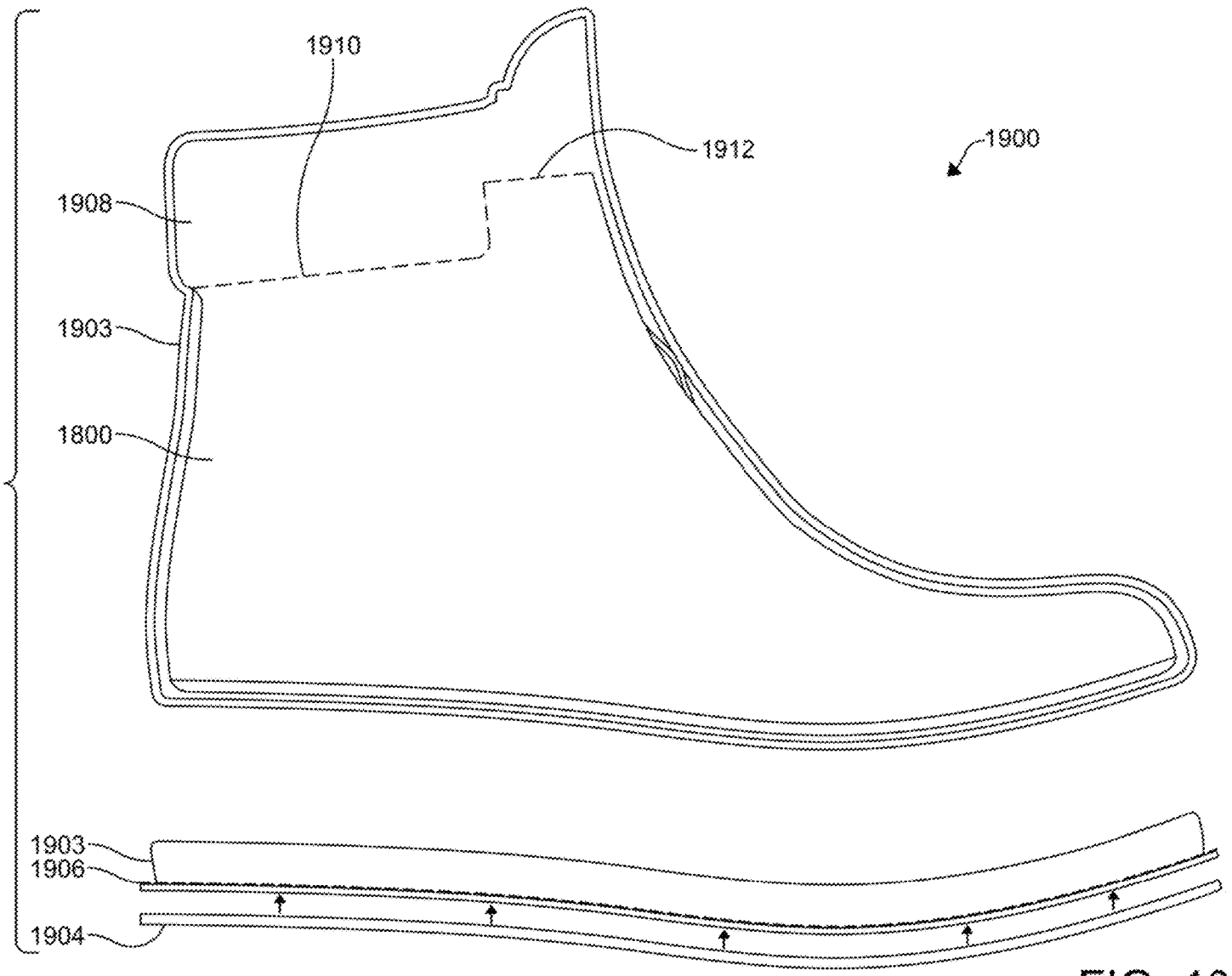
FIG. 19 illustrates a side interior view of an example separable and regenerative footwear article in accordance with the present disclosure.
Figure 20:
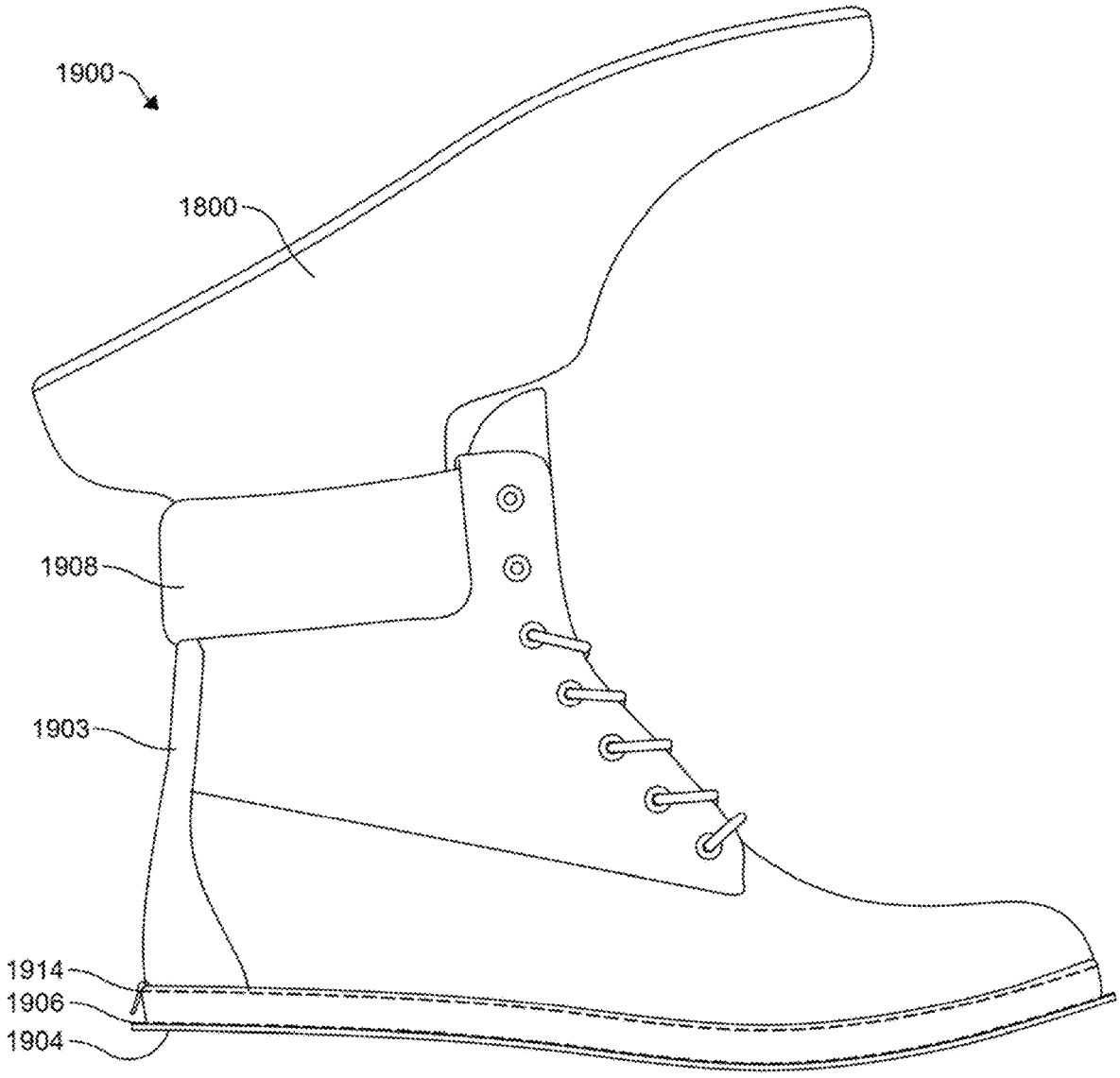
FIG. 20 illustrates a side view of an example separable and regenerative footwear article with an inverted waterproof bootie in accordance with the present disclosure.

FIGS. 19-22 illustrate side views of a footwear article 1900 according to embodiments of the disclosure. FIG. 19 illustrates a side interior view of an example separable and regenerative footwear article 1900 in accordance with the present disclosure. FIG. 20 illustrates a side view of the example separable and regenerative footwear article 1900 with an inverted waterproof bootie 1800 in accordance with the present disclosure. As a non-limiting example, a bootie (e.g., similar to bootie 1800) may be formed separate from the upper and the bootie may be inserted directly into the upper through a hole defined by the collar.

Figure 21:
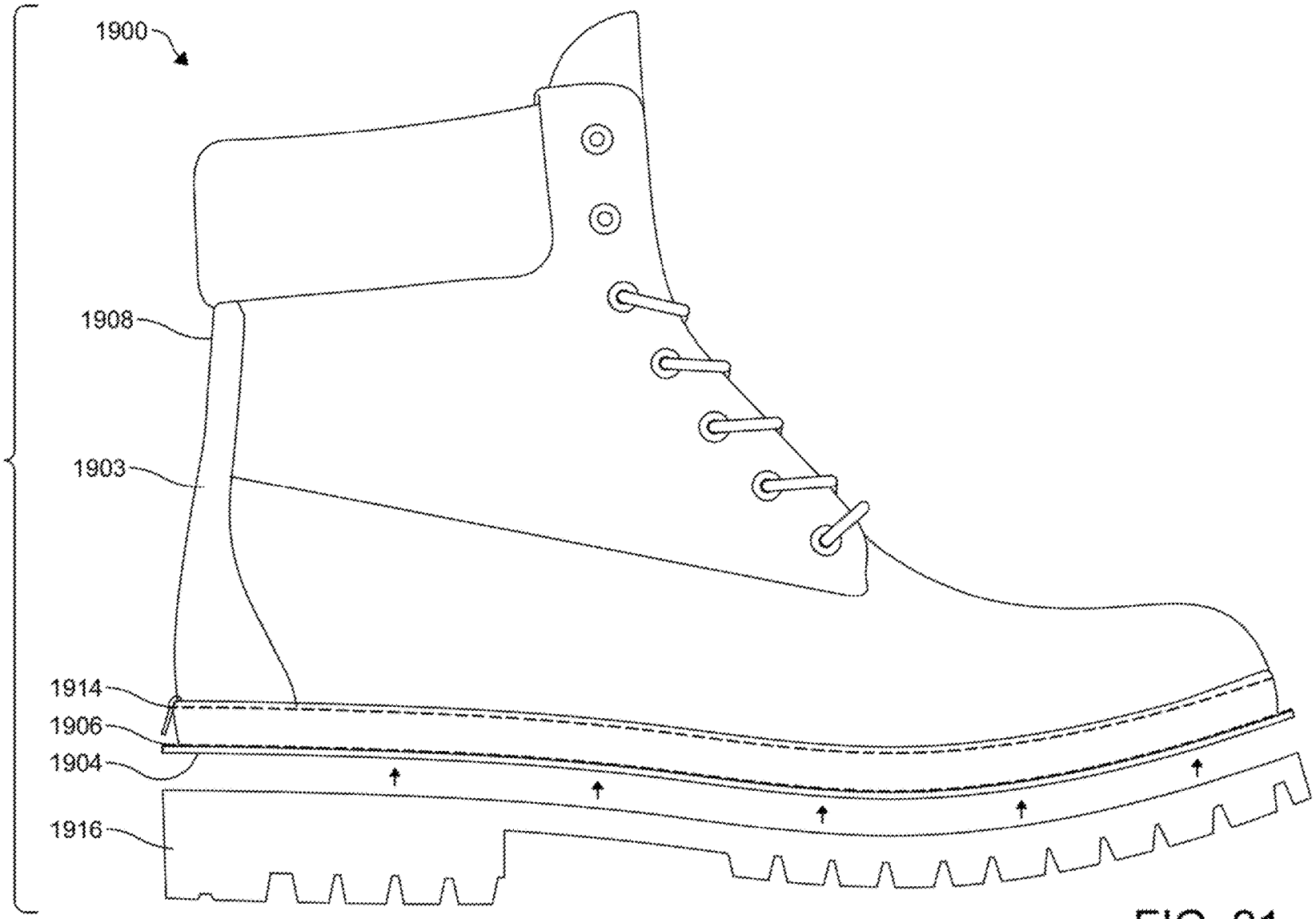
FIG. 21 illustrates a side view of an example separable and regenerative footwear article in accordance with the present disclosure.
Figure 22:
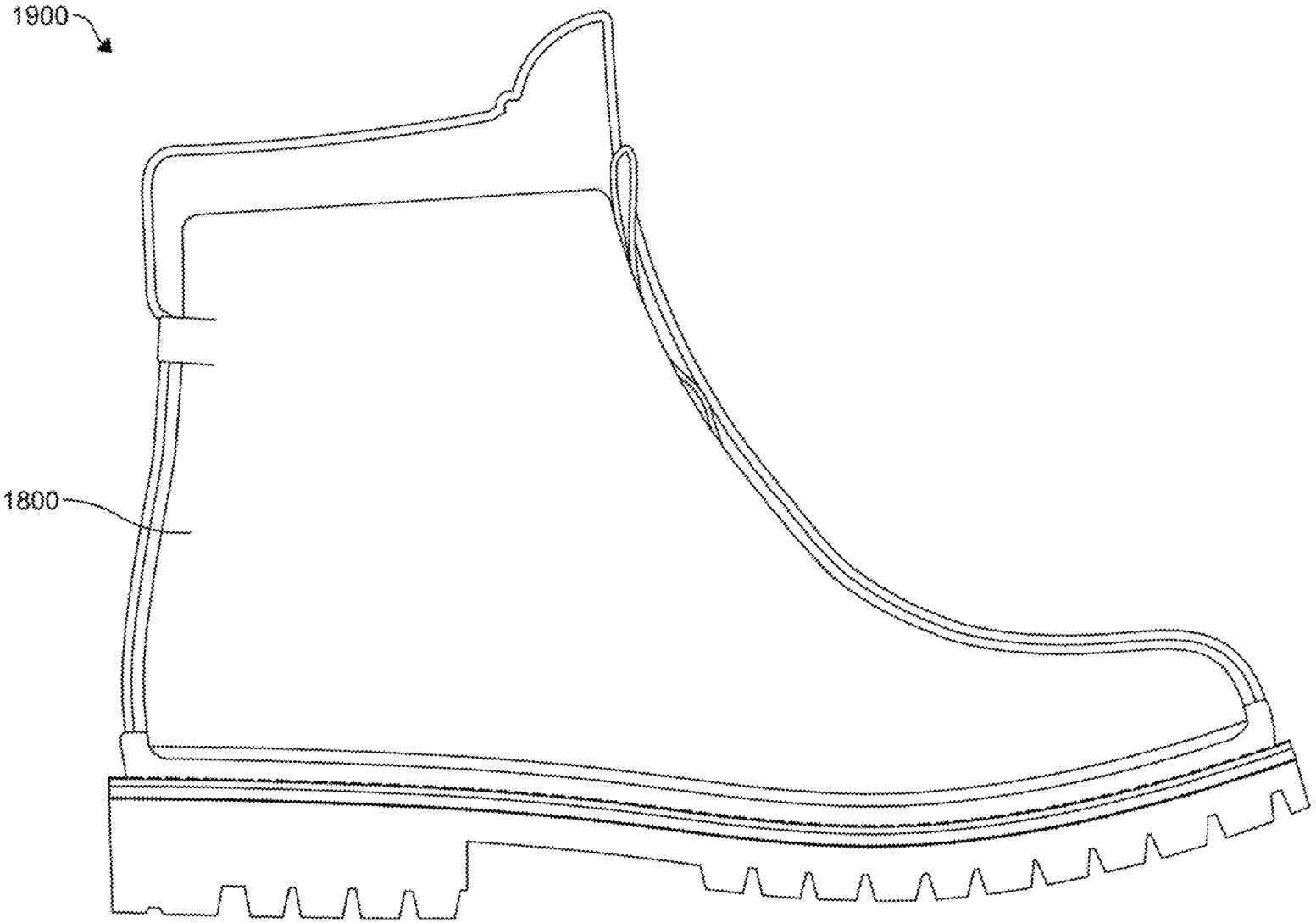
FIG. 22 illustrates a side interior view of an example separable and regenerative footwear article in accordance with the present disclosure.

FIG. 21 illustrates a side view of an example separable and regenerative footwear 1900 article in accordance with the present disclosure. FIG. 22 illustrates a side interior view of an example separable and regenerative footwear article 1900 in accordance with the present disclosure.

The footwear article 1900 may be similar to or include any of the components of any of the separable and regenerative footwear articles described herein (e.g., footwear 100, footwear articles 1500, 1600, 1700, etc.). In this embodiment, a welt 1902 (e.g., a storm welt, Y-welt, T-welt, etc.) may be removeably sewn (e.g., chain stitched, lock stitched, etc.) to a rubber board 1904, along, for example, dotted line 1906. A temporary adhesive may also be applied between the welt 1902 and the rubber board 1904. The separable and regenerative footwear article 1900 may include a waterproof bootie (e.g., bootie 1800 of FIGS. 18A-18C). Waterproof bootie 1800 may be a knit waterproof bootie.

The footwear article 1900 may include an upper 1903 further including a collar 1908. The waterproof bootie 1800 may be partially affixed (e.g., glued, stitched, etc.) to the collar 1908 (e.g., along dotted line 1910). For instance, the waterproof bootie 1800 may be stitched (e.g., chain stitched, lock stitched, etc.) to the collar 1908 along a portion of the interior circumference not including a tongue portion 1912. In this manner, as is shown in FIG. 20, the waterproof bootie 1800 may be inverted and partially removed from the footwear article, while remaining affixed to the collar 1908. The upper 1903 and the welt 1902 of the footwear article may be removably sewn together (e.g., via a chain or lock stitch) along, for example, dotted line 1914, without sewing through the waterproof bootie 1800.

As shown in FIG. 21, an outsole 1916 may be affixed to the rubber board 1904 using, for instance, an adhesive (e.g., rubber cement). Then, as is shown in FIG. 22, the waterproof bootie 1800 may be reinserted into the cavity of the footwear article, and further attached to the upper 1903 via a fastening mechanism (e.g., webbing loops, button snaps, hook-and-loop fabric, stitching (e.g., removable stitching such as chain stitching, lock stitching)), etc.

Figure 23:
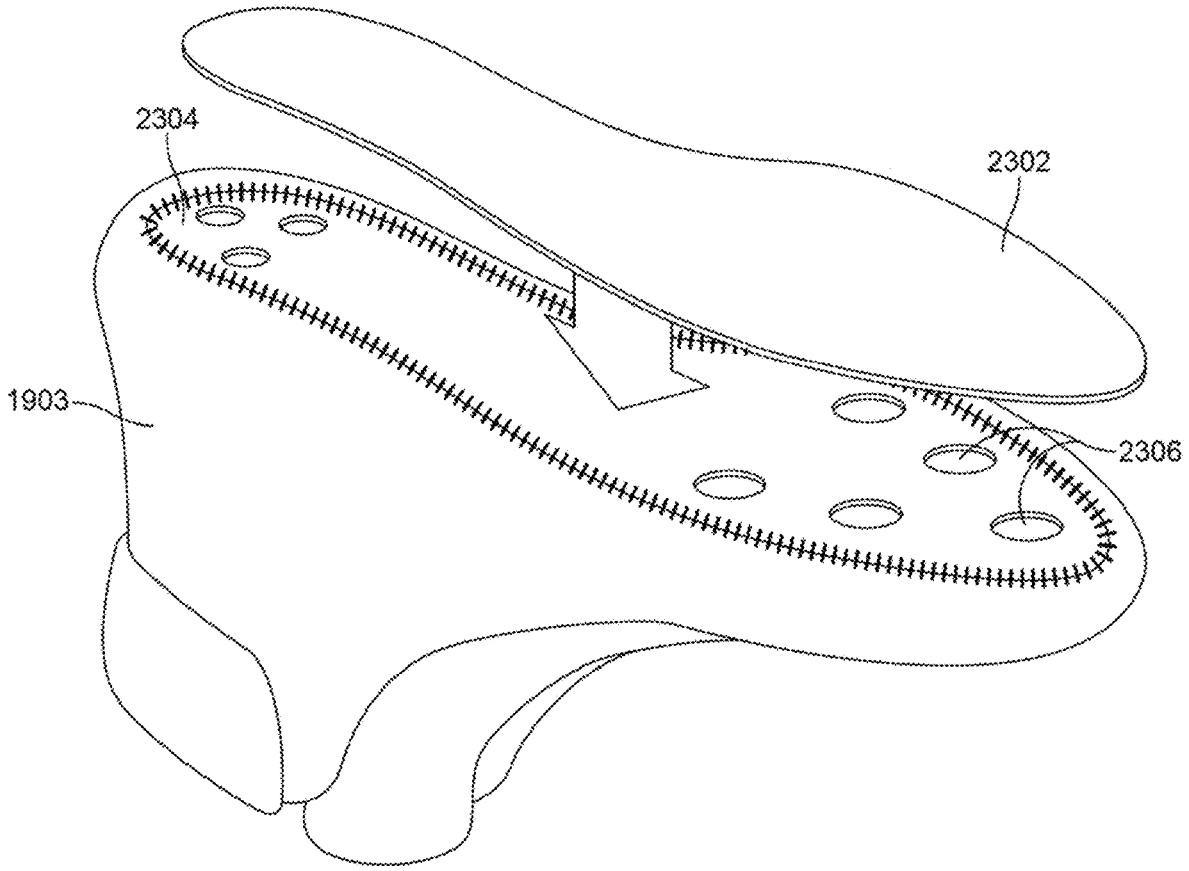
FIG. 23 illustrates a bottom construction of an example separable and regenerative footwear article in accordance with the present disclosure.

FIG. 23 illustrates a bottom construction of an example separable and regenerative footwear article in accordance with the present disclosure. One or each of the upper 1903 and the waterproof bootie 1800 may include a gasket 2302 and a rigid perforated board 2304 (e.g., a Strobel board). In such a construction, the rigid board 2304, may be attached (e.g., sewn) to a bottom portion of an upper may be to create a reinforced sock or bootie. The upper and board may be joined by a Strobel stitch, i.e., using a Strobel machine.

The rigid perforated board 2304 may include a plurality of apertures 2306 or perforations. The plurality of apertures 2306 or perforations may expose of the waterproof bootie 1800. The gasket 2302 may be configured to be attached to the rigid perforated board 2304 after the footwear article components are joined (e.g., lasted). With the upper sock or bootie tightly lasted, the upper may be cemented to the gasket, completing the shoe or the shoe upper. For instance, a glue or cement layer 2308 may be applied to a surface of the rigid perforated board 2304 and the gasket 2302 may be pressed onto the rigid perforated board 2304, such that the adhesive material joins the gasket, rigid perforated board 2304, and waterproof bootie 1800, thereby affixing the waterproof bootie 1800 in place.

Figure 24:
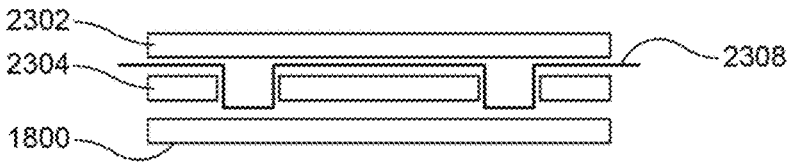
FIG. 24 illustrates a side view of a bottom construction of an example separable and regenerative footwear article in accordance with the present disclosure.

FIG. 24 illustrates a side view of a bottom construction of an example separable and regenerative footwear article in accordance with the present disclosure. As can be seen in FIG. 24, the glue or cement layer 2308 may fill in the apertures 2306 in the rigid perforated board 2304, contacting a bottom surface of the waterproof bootie 1800 to provide additional securing of the rigid perforated board 2304, the gasket 2302 and waterproof bootie 1800.

Figure 25A:
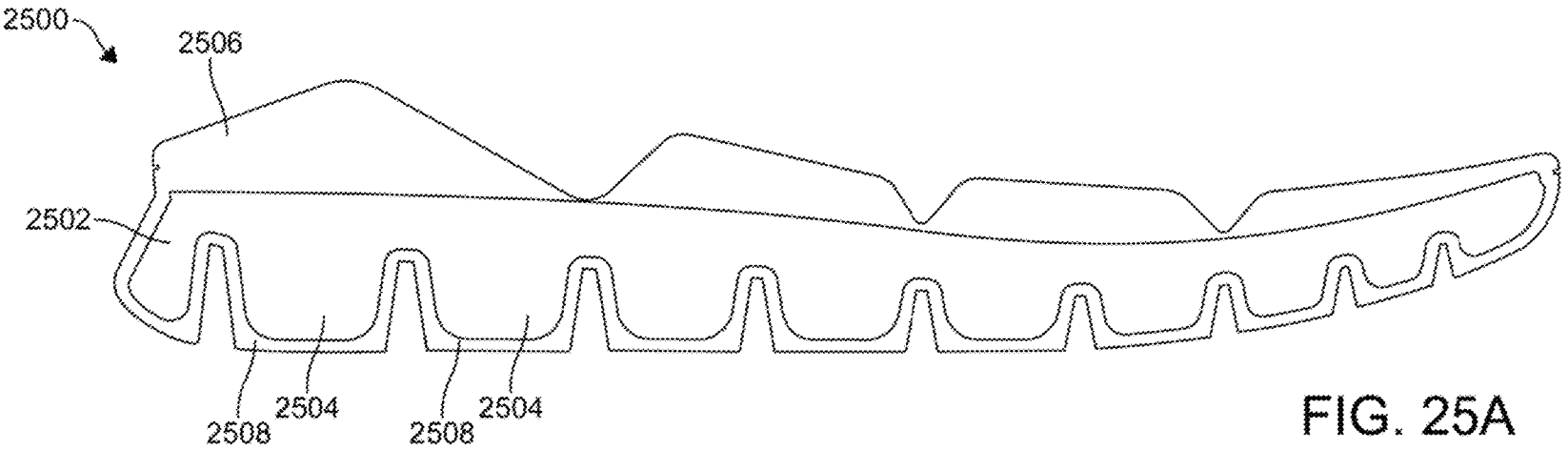
FIGS. 25A-25B illustrate a side view of a midsole construction of an example separable and regenerative footwear article in accordance with the present disclosure.
Figure 25B:
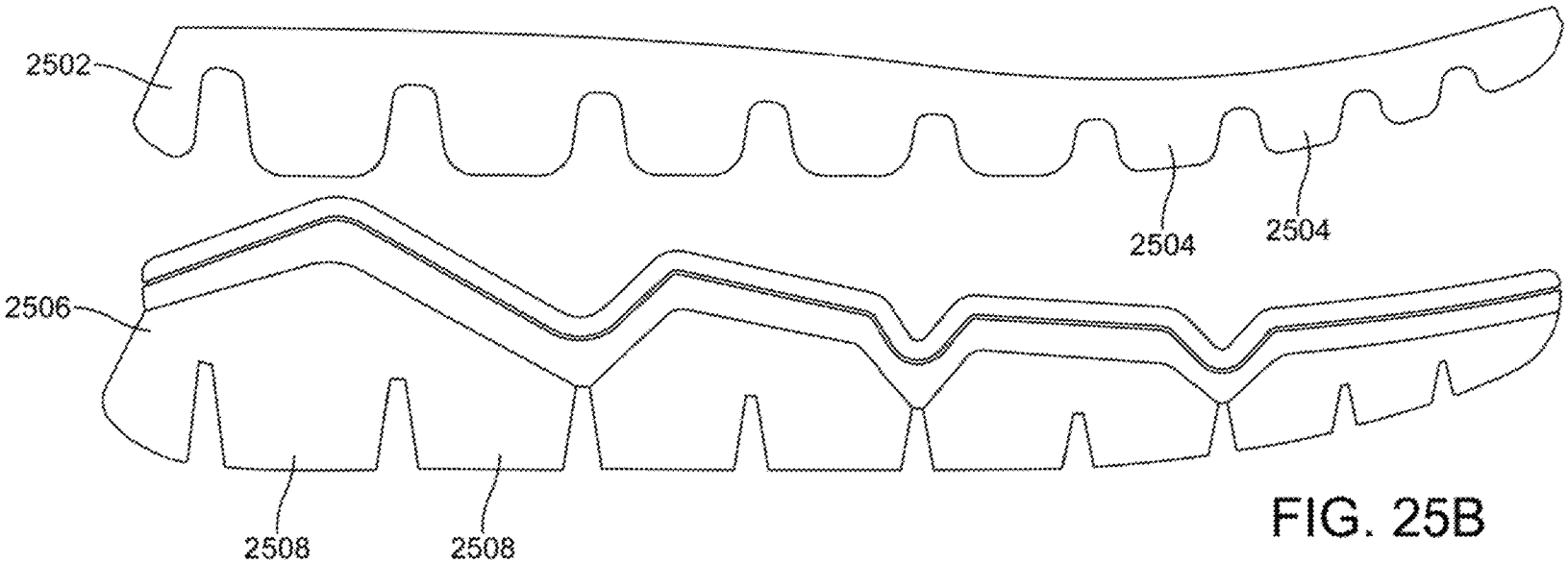

FIGS. 25A-25B illustrate a side view of a midsole and outsole assembly 2500 of an example separable and regenerative footwear article in accordance with the present disclosure. Separable and regenerative footwear articles as described herein may further comprise a removable midsole 2502 configured to be inserted into an outsole 2506 (or, e.g., outsole 130, outsole 1510, etc.). FIG. 25A shows the midsole and outsole assembly 2500 when assembled, and FIG. 25B shows the midsole and outsole components separately. The midsole 2502 may be formed from a foam material (e.g., ethylene-vinyl acetate (EVA). The midsole 2502 may comprise a plurality of protrusions 2504. The protrusions 2504 may be configured to be received by corresponding cavities 2508 in the outsole. The midsole 2502 may be mechanically (e.g., frictionally) secured within the outsole 2506. In this manner, when the footwear article is disassembled (e.g., by removing the removable stitch), the midsole 2502 can easily be separated from the outsole 2506 and recycled.

Figure 26B:
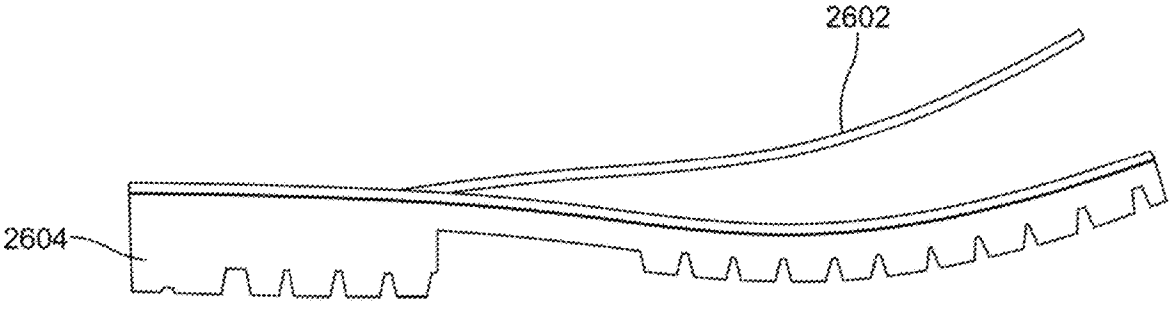
FIGS. 26A-26B illustrate side and top views of an outsole disassembly of an example separable and regenerative footwear article in accordance with the present disclosure.
Figure 26A:
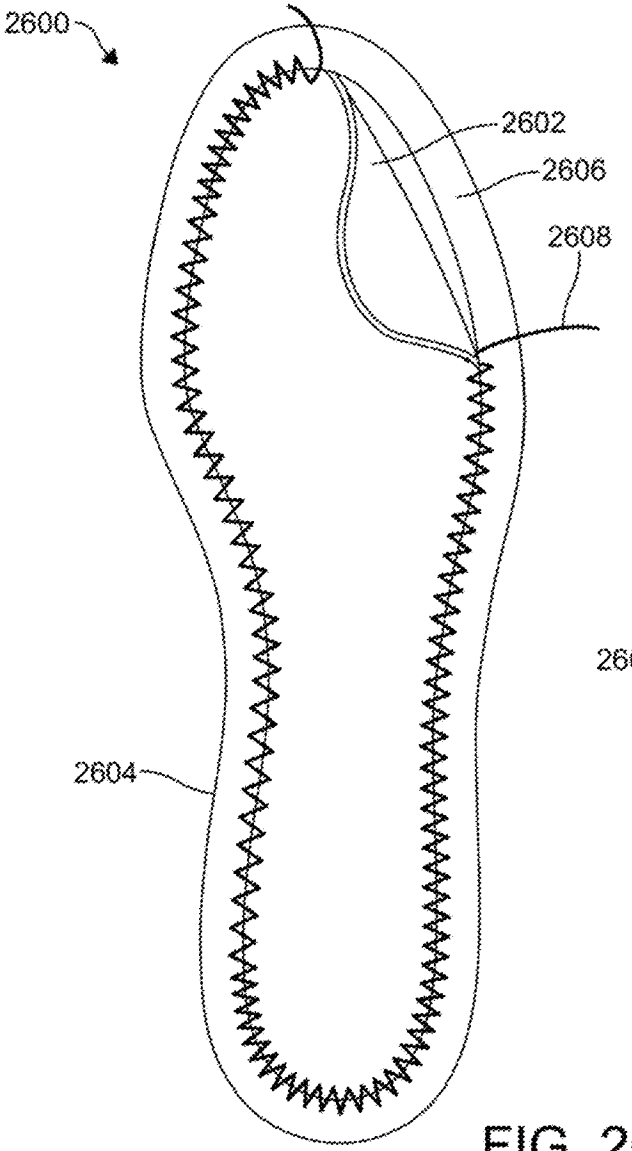

FIGS. 26A, 26B, 27A, and 27B illustrate side and top views of a midsole and outsole assembly 2600 of an additional example separable and regenerative footwear article in accordance with the present disclosure. Separable and regenerative footwear articles as described herein may further comprise a removable top layer midsole 2602 configured to be inserted into an outsole 2604 (or, e.g., outsole 130, outsole 1510, etc.). FIG. 26A shows a top layer midsole 2602 (e.g., an EVA midsole) inset into an outsole 2604. In this embodiment, a perimeter of the top layer midsole 2602 is secured to top edge 2606 of the outsole 2604 via a removable stitch 2608. Once removed, the top layer midsole 2602 can be lifted away from the outsole 2604. FIG. 26B shows a side view of the top layer midsole 2602 lifted away from the outsole 2604, i.e., after the removable stitch (e.g., chain stitch) has been removed.

Figure 27B:
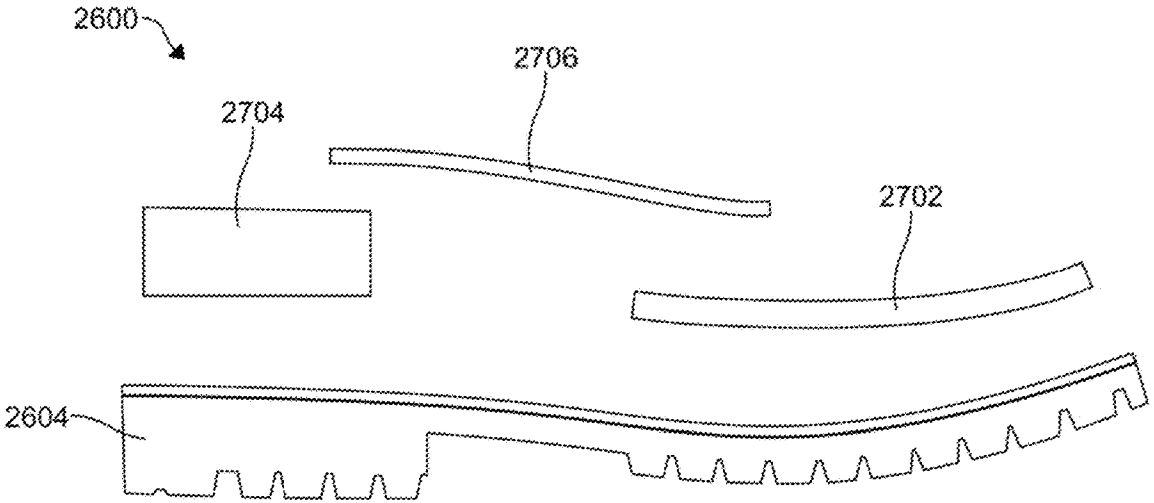
FIGS. 27A-27B illustrate side and top views of an outsole disassembly of an example separable and regenerative footwear article in accordance with the present disclosure.
Figure 27A:
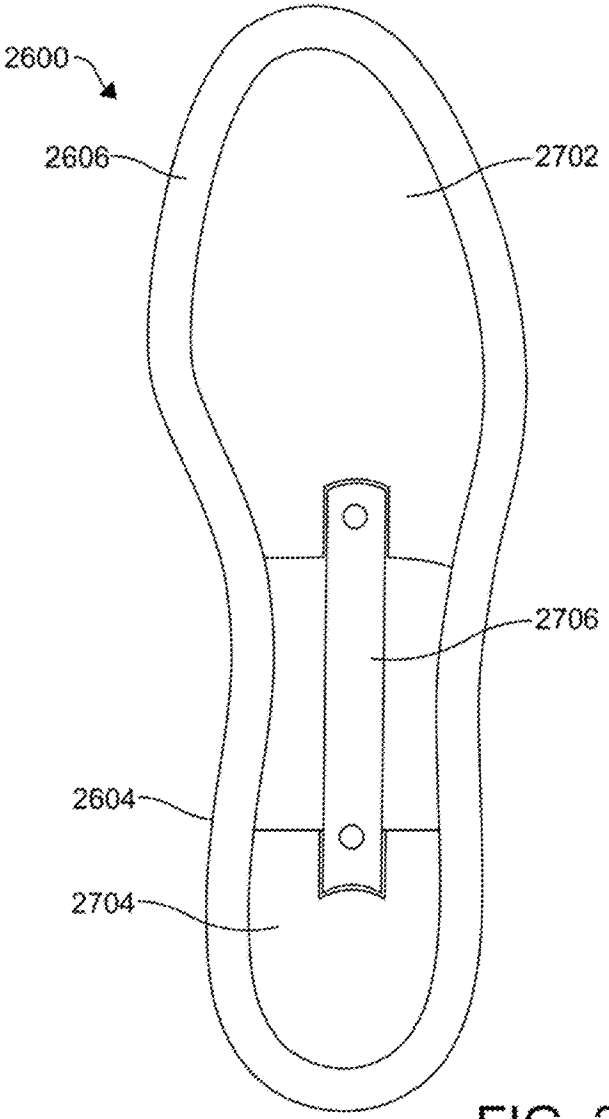

FIGS. 27A-27B illustrate side and top views of further components of a midsole and outsole assembly 2600 of an example separable and regenerative footwear article in accordance with the present disclosure. Additional midsole components may be inset into the outsole, i.e., underneath the top layer midsole 2602 of FIGS. 26A-26B. For instance, a forefoot insert 2702 (e.g., an EVA insert) and a shank 2704 may also be removable during disassembly of the footwear article. The forefoot insert 2702 and shank 2704 may be formed from a foam, EVA, or rubber material to provide cushioning or support. Each of the inset midsole components may be formed from different materials, or may all be formed from the same material. A securing bracket 2706 may be used to hold the components in place until disassembly.

Aspects to be Updated Upon Approval of Specification and Claims

The present disclosure comprises at least the following aspects:

Aspect 1: A separable footwear article comprising: an outsole oriented at a bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are capable of being separated by releasing the thread and hand pulling the thread from the footwear article.

Aspect 2: The separable footwear article of aspect 1, wherein the first material comprises regenerative rubber.

Aspect 3: The separable footwear article of any of aspects 1-2, wherein the first material comprises regenerative polymer.

Aspect 4: The separable footwear article of any of aspects 1-3, wherein the second material comprises leather.

Aspect 5: The separable footwear article of any of aspects 1-4, wherein the third material comprises wool.

Aspect 6: The separable footwear article of any of aspects 1-5, wherein the insole comprises a heel portion and a base portion.

Aspect 7: The separable footwear article of aspect 6, wherein the base portion comprises an inner cushion and an outer support.

Aspect 8: A method of making the separable footwear article of any of aspects 1-7.

Aspect 9: A method of recycling the separable footwear article of any of aspects 1-7, the method comprising: separating the insole from the outsole and the upper portion; releasing the thread; and applying a force to the thread to disengage the thread from the outsole and the upper, thereby separating the outsole from the upper.

Aspect 10: A separable footwear article comprising: an outsole oriented at a bottom of the footwear and configured for ground contact, the outsole comprising a first material; an upper portion releasably coupled to the outsole with thread using chain stitching, the upper portion comprising a second material different from the first material; and an insole removeably disposed adjacent the upper portion and the outsole, the insole comprising a third material different from the first material and the second material; wherein the outsole, the upper portion, and insole are configured to be separated by releasing the thread and pulling the thread from the footwear article.

Aspect 11: The separable footwear article of aspect 10, wherein the first material comprises regenerative rubber.

Aspect 12: The separable footwear article of any of aspects 10-11, wherein the first material comprises regenerative polymer.

Aspect 13: The separable footwear article of any of aspects 10-12, wherein the second material comprises leather.

Aspect 14: The separable footwear article of any of aspects 10-13, wherein the third material comprises wool.

Aspect 15: The separable footwear article of any of aspects 10-14, wherein the insole comprises a heel portion and a base portion.

Aspect 16: The separable footwear article of aspect 15, wherein the base portion comprises an inner cushion and an outer support.

Aspect 17: A method of making the separable footwear article of any of aspects 10-16.

Aspect 18: A method of recycling the separable footwear article of any of aspects 10-16, the method comprising: separating the insole from the outsole and the upper portion; releasing the thread; and applying a force to the thread to disengage the thread from the outsole and the upper, thereby separating the outsole from the upper.

Aspect 19: A separable footwear article comprising: an outsole oriented at a bottom of the footwear and configured for ground contact, the outsole comprising a first material; and an upper portion releasably coupled to the outsole via a coupling mechanism, the upper portion comprising a second material different from the first material; wherein the outsole and the upper portion are capable of being separated by releasing the coupling mechanism.

Aspect 20: The separable footwear article of aspect 19, wherein the coupling mechanism is capable of being released by hand.

Aspect 21: The separable footwear article of any one of aspects 19-20, wherein the coupling mechanism comprises a chain stitch or snaps.

Aspect 22: The separable footwear article of aspect 19, wherein the first material comprises regenerative rubber.

Aspect 23: The separable footwear article of any of aspects 19-22, wherein the first material comprises regenerative polymer.

Aspect 24: The separable footwear article of any of aspects 19-23, wherein the second material comprises leather.

Aspect 25: A method of making the separable footwear article of any of aspects 19-24.

What is claimed is:

1. A separable footwear article comprising:

an outsole oriented at a bottom of the footwear and configured for ground contact, the outsole comprising a first material;

an upper portion comprising a second material different from the first material; and a welt positioned between the outsole and the upper, wherein the welt is releasably coupled to the outsole with a first thread using a first stitching technique, and releasably coupled to the upper portion with a second thread using a second stitching technique, and wherein the outsole, the upper portion, and the welt are configured to be separated upon receipt of a pulling force upon the first thread and the second thread sufficient to remove the first thread and the second thread from the footwear article.

2. The separable footwear article of claim 1, wherein the first material comprises recyclable rubber.

3. The separable footwear article of claim 1, wherein the first material comprises recyclable polymer.

4. The separable footwear article of claim 1, wherein the second material comprises leather.

5. The separable footwear article of claim 1, wherein the welt comprises a T-shaped or Y-shaped welt.

6. The separable footwear article of claim 1, wherein at least one of the first stitching technique or the second stitching technique is a chain stitch.

7. The separable footwear article of claim 6, wherein at least one of the first stitching technique or the second stitching technique is a lock stitch.

8. The separable footwear article of claim 1, further comprising a midsole removeably disposed adjacent the upper portion and the outsole, the midsole comprising a third material different from the first material and the second material.

9. The separable footwear article of claim 1, further comprising a waterproof bootie removeably disposed adjacent the upper portion, wherein the waterproof bootie is affixed to a surface of the upper via a temporary adhesive.

10. A separable footwear article comprising:

an outsole oriented at a bottom of the footwear and configured for ground contact, the outsole comprising a first material;

an upper portion comprising a second material different from the first material;

a waterproof bootie configured to line the interior of the upper; and a welt positioned between the outsole and the upper, wherein the welt is releasably coupled to the outsole with a first thread using a first stitching technique, and releasable coupled to the upper portion with a second thread using a second stitching technique, and wherein the outsole, the upper portion, and the welt are configured to be separated upon receipt of a pulling force upon the first thread and the second thread sufficient to remove the first thread and the second thread from the footwear article.

11. The separable footwear article of claim 10, wherein the waterproof bootie is configured as a multi-layer bootie comprising inner and outer sock layers and an inner waterproof membrane layer.

12. The separable footwear article of claim 11, wherein the inner waterproof membrane layer is folded into the sock layers such that the waterproof membrane layer is trapped between the sock layers.

13. The separable footwear article of claim 12, wherein the waterproof bootie is partially affixed to a collar of the upper along a portion of the interior circumference of the upper not including a tongue portion of the upper.

14. The separable footwear article of claim 11, wherein the waterproof bootie is configured to be inverted and partially removed from the footwear article, while remaining affixed to the collar such that the upper and the welt of the footwear article can be removeably sewn together without sewing through the waterproof bootie.

15. A separable footwear article comprising:

an outsole oriented at a bottom of the footwear and configured for ground contact, the outsole comprising a first material;

an upper portion comprising a second material different from the first material; and a midsole positioned between the outsole and the upper, wherein the midsole comprises top layer and a plurality of midsole components positioned underneath the top layer, wherein the plurality of midsole components comprise a forefoot insert, a shank insert, and a securing bracket configured to hold the forefoot insert and shank insert together until disassembly, and wherein the top layer of the midsole is removeably secured to a top edge of the outsole via a removable stitch, wherein the outsole and the upper are releasably coupled with a thread using a using a chain stitching technique, wherein the outsole and the upper portion are configured to be separated upon receipt of a pulling force upon the thread sufficient to remove the thread from the footwear article, and wherein the midsole is configured to be removeably inset into the outsole and frictionally held within the outsole such that, upon separation of the outsole and the upper, the midsole is configured to be removed from the outsole and recycled separately.

16. The separable footwear article of claim 15, wherein the midsole is formed from an EVA material.

17. The separable footwear article of claim 15, wherein the midsole comprises midsole comprises a plurality of protrusions configured to be received by corresponding cavities in the outsole.

* * * * *